US011542786B2

(12) United States Patent
Hinderliter et al.

(10) Patent No.: US 11,542,786 B2
(45) Date of Patent: Jan. 3, 2023

(54) HIGH CAPACITY POWER STORAGE SYSTEM FOR ELECTRIC HYDRAULIC FRACTURING

(71) Applicant: U.S. Well Services, LLC, Houston, TX (US)

(72) Inventors: Brandon N. Hinderliter, Houston, TX (US); Jared Oehring, Houston, TX (US); Steven Riley, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

(21) Appl. No.: 16/943,727

(22) Filed: Jul. 30, 2020

(65) Prior Publication Data

US 2021/0032961 A1 Feb. 4, 2021

Related U.S. Application Data

(60) Provisional application No. 62/881,714, filed on Aug. 1, 2019.

(51) Int. Cl.

| | |
|---|---|
| ***E21B 43/26*** | (2006.01) |
| ***E21B 41/00*** | (2006.01) |
| *E21B 43/16* | (2006.01) |

(52) U.S. Cl.

CPC ..... *E21B 41/0085* (2013.01); *E21B 43/2607* (2020.05); *E21B 43/16* (2013.01)

(58) Field of Classification Search

CPC ..... E21B 43/26

See application file for complete search history.

(56) References Cited

U.S. PATENT DOCUMENTS

| | | | |
|---|---|---|---|
| 1,656,861 | A | 1/1928 | Leonard |
| 1,671,436 | A | 5/1928 | Melott |
| 2,004,077 | A | 6/1935 | McCartney |
| 2,183,364 | A | 12/1939 | Bailey |
| 2,220,622 | A | 11/1940 | Aitken |
| 2,248,051 | A | 7/1941 | Armstrong |
| 2,389,328 | A | 11/1945 | Stilwell |

(Continued)

FOREIGN PATENT DOCUMENTS

| | | |
|---|---|---|
| AU | 734988 | 9/1997 |
| AU | 2011203353 | 7/2011 |

(Continued)

OTHER PUBLICATIONS

Non-Final Office dated Oct. 26, 2020 in U.S. Appl. No. 15/356,436.

(Continued)

*Primary Examiner* — Kenneth L Thompson

(74) *Attorney, Agent, or Firm* — Hogan Lovells US LLP

(57) ABSTRACT

A system for powering electric hydraulic fracturing equipment, the system including a power storage system and electric powered hydraulic fracturing equipment in selective electrical communication with the power storage system. The system further includes at least one circuit breaker between the power storage system and the electric powered hydraulic fracturing equipment, the circuit breaker configured to facilitate or prevent electrical communication between the power storage system and the electric powered hydraulic fracturing equipment.

19 Claims, 8 Drawing Sheets

(56) References Cited

U.S. PATENT DOCUMENTS

| | | | |
|---|---|---|---|
| 2,407,796 | A | 9/1946 | Page |
| 2,416,848 | A | 3/1947 | Rothery |
| 2,610,741 | A | 9/1952 | Schmid |
| 2,753,940 | A | 7/1956 | Bonner |
| 2,976,025 | A | 3/1961 | Pro |
| 3,055,682 | A | 9/1962 | Bacher |
| 3,061,039 | A | 10/1962 | Peters |
| 3,066,503 | A | 12/1962 | Fleming |
| 3,302,069 | A | 1/1967 | Webster |
| 3,334,495 | A | 8/1967 | Jensen |
| 3,601,198 | A | 8/1971 | Ahearn |
| 3,722,595 | A | 3/1973 | Kiel |
| 3,764,233 | A | 10/1973 | Strickland |
| 3,773,140 | A | 11/1973 | Mahajan |
| 3,837,179 | A | 9/1974 | Barth |
| 3,849,662 | A | 11/1974 | Blaskowski |
| 3,878,884 | A | 4/1975 | Raleigh |
| 3,881,551 | A | 5/1975 | Terry |
| 3,978,877 | A | 9/1976 | Cox |
| 4,037,431 | A | 7/1977 | Sugimoto |
| 4,066,869 | A | 1/1978 | Apaloo |
| 4,100,822 | A | 7/1978 | Rosman |
| 4,151,575 | A | 4/1979 | Hogue |
| 4,226,299 | A | 10/1980 | Hansen |
| 4,265,266 | A | 5/1981 | Kierbow et al. |
| 4,411,313 | A | 10/1983 | Johnson et al. |
| 4,421,975 | A | 12/1983 | Stein |
| 4,432,064 | A | 2/1984 | Barker |
| 4,442,665 | A | 4/1984 | Fick et al. |
| 4,456,092 | A | 6/1984 | Kubozuka |
| 4,506,982 | A | 3/1985 | Smithers et al. |
| 4,512,387 | A | 4/1985 | Rodriguez |
| 4,529,887 | A | 7/1985 | Johnson |
| 4,538,916 | A | 9/1985 | Zimmerman |
| 4,601,629 | A | 7/1986 | Zimmerman |
| 4,676,063 | A | 6/1987 | Goebel et al. |
| 4,759,674 | A | 7/1988 | Schroder |
| 4,768,884 | A | 9/1988 | Elkin |
| 4,793,386 | A | 12/1988 | Sloan |
| 4,845,981 | A | 7/1989 | Pearson |
| 4,877,956 | A | 10/1989 | Priest |
| 4,922,463 | A | 5/1990 | Del Zotto et al. |
| 5,004,400 | A | 4/1991 | Handke |
| 5,006,044 | A | 4/1991 | Walker, Sr. |
| 5,025,861 | A | 6/1991 | Huber et al. |
| 5,050,673 | A | 9/1991 | Baldridge |
| 5,114,239 | A | 5/1992 | Allen |
| 5,130,628 | A | 7/1992 | Owen |
| 5,131,472 | A | 7/1992 | Dees et al. |
| 5,134,328 | A | 7/1992 | Johnatakis |
| 5,172,009 | A | 12/1992 | Mohan |
| 5,189,388 | A | 2/1993 | Mosley |
| 5,230,366 | A | 7/1993 | Marandi |
| 5,334,898 | A | 8/1994 | Skybyk |
| 5,334,899 | A | 8/1994 | Skybyk |
| 5,366,324 | A | 11/1994 | Arlt |
| 5,422,550 | A | 6/1995 | McClanahan |
| 5,433,243 | A | 7/1995 | Griswold |
| 5,439,066 | A | 8/1995 | Gipson |
| 5,486,047 | A | 1/1996 | Zimmerman |
| 5,517,593 | A | 5/1996 | Nenniger |
| 5,517,822 | A | 5/1996 | Haws et al. |
| 5,548,093 | A | 8/1996 | Sato |
| 5,590,976 | A | 1/1997 | Kilheffer et al. |
| 5,655,361 | A | 8/1997 | Kishi |
| 5,712,802 | A | 1/1998 | Kumar |
| 5,736,838 | A | 4/1998 | Dove et al. |
| 5,755,096 | A | 5/1998 | Holleyman |
| 5,790,972 | A | 8/1998 | Kohlenberger |
| 5,798,596 | A | 8/1998 | Lordo |
| 5,813,455 | A | 9/1998 | Pratt et al. |
| 5,865,247 | A | 2/1999 | Paterson |
| 5,879,137 | A | 3/1999 | Yie |
| 5,894,888 | A | 4/1999 | Wiemers |
| 5,907,970 | A | 6/1999 | Havlovick et al. |
| 5,950,726 | A | 9/1999 | Roberts |
| 6,007,227 | A | 12/1999 | Carlson |
| 6,035,265 | A | 3/2000 | Dister et al. |
| 6,059,539 | A | 5/2000 | Nyilas |
| 6,097,310 | A | 8/2000 | Harrell et al. |
| 6,116,040 | A | 9/2000 | Stark |
| 6,121,705 | A | 9/2000 | Hoong |
| 6,138,764 | A | 10/2000 | Scarsdale et al. |
| 6,142,878 | A | 11/2000 | Barin |
| 6,164,910 | A | 12/2000 | Mayleben |
| 6,167,965 | B1 | 1/2001 | Bearden |
| 6,202,702 | B1 | 3/2001 | Ohira |
| 6,208,098 | B1 | 3/2001 | Kume |
| 6,254,462 | B1 | 7/2001 | Kelton |
| 6,271,637 | B1 | 8/2001 | Kushion |
| 6,273,193 | B1 | 8/2001 | Hermann et al. |
| 6,315,523 | B1 | 11/2001 | Mills |
| 6,321,860 | B1 | 11/2001 | Reddoch |
| 6,442,942 | B1 | 9/2002 | Kopko |
| 6,477,852 | B2 | 11/2002 | Dodo |
| 6,484,490 | B1 | 11/2002 | Olsen |
| 6,491,098 | B1 | 12/2002 | Dallas |
| 6,529,135 | B1 | 3/2003 | Bowers et al. |
| 6,560,131 | B1 | 5/2003 | VonBrethorst |
| 6,585,455 | B1 | 7/2003 | Petersen et al. |
| 6,626,646 | B2 | 9/2003 | Rajewski |
| 6,719,900 | B2 | 4/2004 | Hawkins |
| 6,765,304 | B2 | 7/2004 | Baten et al. |
| 6,776,227 | B2 | 8/2004 | Beida |
| 6,786,051 | B2 | 9/2004 | Kristich |
| 6,788,022 | B2 | 9/2004 | Sopko |
| 6,802,690 | B2 | 10/2004 | Han |
| 6,808,303 | B2 | 10/2004 | Fisher |
| 6,857,486 | B2 | 2/2005 | Chitwood |
| 6,931,310 | B2 | 8/2005 | Shimizu et al. |
| 6,936,947 | B1 | 8/2005 | Leijon |
| 6,985,750 | B1 | 1/2006 | Vicknair |
| 7,006,792 | B2 | 2/2006 | Wilson |
| 7,011,152 | B2 | 3/2006 | Soelvik |
| 7,082,993 | B2 | 8/2006 | Ayoub |
| 7,104,233 | B2 | 9/2006 | Ryczek et al. |
| 7,170,262 | B2 | 1/2007 | Pettigrew |
| 7,173,399 | B2 | 2/2007 | Sihler |
| 7,308,933 | B1 | 12/2007 | Mayfield |
| 7,312,593 | B1 | 12/2007 | Streicher et al. |
| 7,336,514 | B2 | 2/2008 | Amarillas |
| 7,445,041 | B2 | 11/2008 | O'Brien |
| 7,494,263 | B2 | 2/2009 | Dykstra et al. |
| 7,500,642 | B2 | 3/2009 | Cunningham |
| 7,525,264 | B2 | 4/2009 | Dodge |
| 7,563,076 | B2 | 7/2009 | Brunet |
| 7,581,379 | B2 | 9/2009 | Yoshida |
| 7,660,648 | B2 | 2/2010 | Dykstra |
| 7,675,189 | B2 | 3/2010 | Grenier |
| 7,683,499 | B2 | 3/2010 | Saucier |
| 7,717,193 | B2 | 5/2010 | Egilsson et al. |
| 7,755,310 | B2 | 7/2010 | West et al. |
| 7,795,830 | B2 | 9/2010 | Johnson |
| 7,807,048 | B2 | 10/2010 | Collette |
| 7,835,140 | B2 | 11/2010 | Mori |
| 7,845,413 | B2 | 12/2010 | Shampine et al. |
| 7,901,314 | B2 | 3/2011 | Salvaire |
| 7,926,562 | B2 | 4/2011 | Poitzsch |
| 7,949,483 | B2 | 5/2011 | Discenzo |
| 7,971,650 | B2 | 7/2011 | Yuratich |
| 7,977,824 | B2 | 7/2011 | Halen et al. |
| 7,984,757 | B1 | 7/2011 | Keast |
| 8,037,936 | B2 | 10/2011 | Neuroth |
| 8,054,084 | B2 | 11/2011 | Schulz et al. |
| 8,069,710 | B2 | 12/2011 | Dodd |
| 8,083,504 | B2 | 12/2011 | Williams |
| 8,091,928 | B2 | 1/2012 | Carrier |
| 8,096,354 | B2 | 1/2012 | Poitzsch |
| 8,096,891 | B2 | 1/2012 | Lochtefeld |
| 8,139,383 | B2 | 3/2012 | Efraimsson |
| 8,146,665 | B2 | 4/2012 | Neal |
| 8,154,419 | B2 | 4/2012 | Daussin et al. |
| 8,174,853 | B2 | 5/2012 | Kane |
| 8,232,892 | B2 | 7/2012 | Overholt et al. |

(56) References Cited

U.S. PATENT DOCUMENTS 8,261,528 B2 9/2012 Chillar
8,272,439 B2 9/2012 Strickland
8,310,272 B2 11/2012 Quarto
8,354,817 B2 1/2013 Yeh et al.
8,379,424 B2 2/2013 Grbovic
8,469,097 B2 6/2013 Gray
8,474,521 B2 7/2013 Kajaria
8,503,180 B2 8/2013 Nojima
8,506,267 B2 8/2013 Gambier
8,534,235 B2 9/2013 Chandler
8,534,366 B2 9/2013 Fielder
8,573,303 B2 11/2013 Kerfoot
8,596,056 B2 12/2013 Woodmansee
8,616,005 B1 12/2013 Cousino
8,616,274 B2 12/2013 Belcher et al.
8,622,128 B2 1/2014 Hegeman
8,628,627 B2 1/2014 Sales
8,646,521 B2 2/2014 Bowen
8,692,408 B2 4/2014 Zhang et al.
8,727,068 B2 5/2014 Bruin
8,727,737 B2 5/2014 Seitter
8,727,783 B2 5/2014 Chen
8,760,657 B2 6/2014 Pope
8,763,387 B2 * 7/2014 Schmidt ..... F03B 13/06 60/398
8,774,972 B2 7/2014 Rusnak et al.
8,789,601 B2 7/2014 Broussard
8,789,609 B2 7/2014 Smith
8,795,525 B2 * 8/2014 McGinnis ..... C02F 1/14 210/321.66
8,800,652 B2 8/2014 Bartko
8,807,960 B2 8/2014 Stephenson
8,838,341 B2 9/2014 Kumano
8,851,860 B1 10/2014 Mail
8,857,506 B2 10/2014 Stone, Jr.
8,874,383 B2 10/2014 Gambier
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,051,923 B2 * 6/2015 Kuo ..... F03G 6/005
9,061,223 B2 6/2015 Winborn
9,062,545 B2 6/2015 Roberts et al.
9,067,182 B2 6/2015 Nichols
9,080,412 B2 7/2015 Wetzel
9,103,193 B2 8/2015 Coli
9,119,326 B2 8/2015 McDonnell
9,121,257 B2 9/2015 Coli
9,140,105 B2 9/2015 Pattillo
9,140,110 B2 9/2015 Coli et al.
9,160,168 B2 10/2015 Chapel
9,260,253 B2 2/2016 Naizer
9,322,239 B2 4/2016 Angeles Boza et al.
9,324,049 B2 4/2016 Thomeer
9,340,353 B2 5/2016 Oren
9,353,593 B1 5/2016 Lu et al.
9,366,114 B2 6/2016 Coli et al.
9,410,410 B2 8/2016 Broussard et al.
9,450,385 B2 9/2016 Kristensen
9,475,020 B2 10/2016 Coli et al.
9,475,021 B2 10/2016 Coli et al.
9,482,086 B2 11/2016 Richardson et al.
9,499,335 B2 11/2016 McIver
9,506,333 B2 11/2016 Castillo et al.
9,513,055 B1 12/2016 Seal
9,534,473 B2 1/2017 Morris et al.
9,562,420 B2 2/2017 Morris et al.
9,587,649 B2 3/2017 Oehring
9,611,728 B2 * 4/2017 Oehring ..... F04B 9/10
9,650,871 B2 5/2017 Oehring et al.
9,650,879 B2 5/2017 Broussard et al.
9,706,185 B2 7/2017 Ellis
9,728,354 B2 8/2017 Skolozdra
9,738,461 B2 8/2017 DeGaray
9,739,546 B2 8/2017 Bertilsson et al.
9,745,840 B2 8/2017 Oehring et al.
9,790,858 B2 10/2017 Kanebako
9,822,631 B2 11/2017 Ravi
9,840,897 B2 12/2017 Larson
9,840,901 B2 12/2017 Oehring et al.
9,841,026 B2 12/2017 Stinessen
9,863,228 B2 1/2018 Shampine et al.
RE46,725 E 2/2018 Case
9,893,500 B2 2/2018 Oehring
9,909,398 B2 3/2018 Pham
9,915,128 B2 3/2018 Hunter
9,932,799 B2 4/2018 Symchuk
9,945,365 B2 4/2018 Hernandez et al.
9,963,961 B2 * 5/2018 Hardin ..... G05D 9/12
9,970,278 B2 5/2018 Broussard
9,976,351 B2 5/2018 Randall
9,995,218 B2 6/2018 Oehring
10,008,880 B2 6/2018 Vicknair
10,020,711 B2 7/2018 Oehring
10,036,238 B2 7/2018 Oehring
10,107,086 B2 10/2018 Oehring
10,119,381 B2 11/2018 Oehring
10,167,863 B1 1/2019 Cook
10,184,465 B2 * 1/2019 Enis ..... F04B 25/00
10,196,878 B2 2/2019 Hunter
10,221,639 B2 3/2019 Romer et al.
10,227,854 B2 3/2019 Glass
10,232,332 B2 3/2019 Oehring
10,246,984 B2 4/2019 Payne
10,254,732 B2 4/2019 Oehring
10,260,327 B2 4/2019 Kajaria
10,280,724 B2 5/2019 Hinderliter
10,287,873 B2 5/2019 Filas
10,302,079 B2 5/2019 Kendrick
10,309,205 B2 6/2019 Randall
10,337,308 B2 7/2019 Broussard
10,371,012 B2 8/2019 Davis
10,378,326 B2 8/2019 Morris
10,393,108 B2 8/2019 Chong
10,407,990 B2 9/2019 Oehring
10,408,030 B2 9/2019 Oehring et al.
10,408,031 B2 9/2019 Oehring et al.
10,415,332 B2 9/2019 Morris et al.
10,436,026 B2 10/2019 Ounadjela
10,443,660 B2 10/2019 Harris
10,627,003 B2 * 4/2020 Dale ..... F16K 17/168
10,648,270 B2 5/2020 Brunty et al.
10,648,311 B2 5/2020 Oehring et al.
10,669,471 B2 * 6/2020 Schmidt ..... B01D 61/06
10,669,804 B2 6/2020 Kotrla
10,686,301 B2 6/2020 Oehring et al.
10,695,950 B2 6/2020 Igo et al.
10,711,576 B2 * 7/2020 Bishop ..... H02J 3/381
10,731,561 B2 8/2020 Oehring et al.
10,740,730 B2 8/2020 Altamirano et al.
10,767,561 B2 9/2020 Brady
10,781,752 B2 9/2020 Kikkawa et al.
10,794,165 B2 10/2020 Fischer et al.
10,988,998 B2 4/2021 Fischer et al.
2001/0000996 A1 5/2001 Grimland et al.
2002/0169523 A1 11/2002 Ross et al.
2003/0000759 A1 1/2003 Schmitz
2003/0079875 A1 1/2003 Weng
2003/0056514 A1 3/2003 Lohn
2003/0138327 A1 7/2003 Jones et al.
2004/0040746 A1 3/2004 Niedermayr et al.
2004/0045703 A1 3/2004 Hooper et al.
2004/0102109 A1 5/2004 Cratty et al.
2004/0167738 A1 8/2004 Miller
2005/0061548 A1 3/2005 Hooper
2005/0116541 A1 6/2005 Seiver
2005/0201197 A1 9/2005 Duell et al.
2005/0274508 A1 12/2005 Folk
2006/0052903 A1 3/2006 Bassett
2006/0065319 A1 3/2006 Csitari
2006/0109141 A1 5/2006 Huang
2007/0125544 A1 6/2007 Robinson

(56) References Cited

U.S. PATENT DOCUMENTS

2007/0131410 A1 6/2007 Hill
2007/0151731 A1 7/2007 Butler
2007/0187163 A1 8/2007 Cone
2007/0201305 A1 8/2007 Heilman et al.
2007/0204991 A1 9/2007 Loree
2007/0226089 A1 9/2007 DeGaray et al.
2007/0277982 A1 12/2007 Shampine
2007/0278140 A1 12/2007 Mallet et al.
2008/0017369 A1 1/2008 Sarada
2008/0041596 A1 2/2008 Blount
2008/0066911 A1 3/2008 Luharuka
2008/0095644 A1 4/2008 Mantei et al.
2008/0112802 A1 5/2008 Orlando
2008/0137266 A1 6/2008 Jensen
2008/0164023 A1 7/2008 Dykstra et al.
2008/0187444 A1 8/2008 Molotkov
2008/0208478 A1 8/2008 Ella et al.
2008/0217024 A1 9/2008 Moore
2008/0257449 A1 10/2008 Weinstein et al.
2008/0264625 A1 10/2008 Ochoa
2008/0264649 A1 10/2008 Crawford
2008/0277120 A1 11/2008 Hickie
2008/0303469 A1 12/2008 Nojima
2009/0045782 A1 2/2009 Datta
2009/0065299 A1 3/2009 Vito
2009/0072645 A1 3/2009 Quere
2009/0078410 A1 3/2009 Krenek et al.
2009/0093317 A1 4/2009 Kajiwara et al.
2009/0095482 A1 4/2009 Surjaatmadja
2009/0101410 A1 4/2009 Egilsson
2009/0145611 A1 6/2009 Pallini, Jr.
2009/0153354 A1 6/2009 Daussin et al.
2009/0188181 A1 7/2009 Forbis
2009/0194273 A1 8/2009 Surjaatmadja
2009/0200035 A1 8/2009 Bjerkreim et al.
2009/0260826 A1 10/2009 Sherwood
2009/0308602 A1 12/2009 Bruins et al.
2010/0000508 A1 1/2010 Chandler
2010/0019574 A1 1/2010 Baldassarre et al.
2010/0038077 A1 2/2010 Heilman
2010/0038907 A1 2/2010 Hunt
2010/0045109 A1 2/2010 Arnold
2010/0051272 A1 3/2010 Loree et al.
2010/0132949 A1 6/2010 DeFosse et al.
2010/0146981 A1 6/2010 Motakef
2010/0172202 A1 7/2010 Borgstadt
2010/0250139 A1 9/2010 Hobbs et al.
2010/0293973 A1 11/2010 Erickson
2010/0300683 A1 12/2010 Looper
2010/0303655 A1 12/2010 Scekic
2010/0310384 A1 12/2010 Stephenson
2010/0322802 A1 12/2010 Kugelev
2011/0005757 A1 1/2011 Hebert
2011/0017468 A1 1/2011 Birch et al.
2011/0052423 A1 3/2011 Gambier
2011/0061855 A1 3/2011 Case et al.
2011/0079302 A1 4/2011 Hawes
2011/0081268 A1 4/2011 Ochoa et al.
2011/0085924 A1 4/2011 Shampine
2011/0110793 A1 5/2011 Leugemores et al.
2011/0166046 A1 7/2011 Weaver
2011/0194256 A1 8/2011 De Rijck
2011/0247831 A1 10/2011 Smith
2011/0247878 A1 10/2011 Rasheed
2011/0272158 A1 11/2011 Neal
2012/0018016 A1 1/2012 Gibson
2012/0049625 A1 3/2012 Hopwood
2012/0063936 A1 3/2012 Baxter et al.
2012/0067582 A1 3/2012 Fincher
2012/0085541 A1 4/2012 Love et al.
2012/0112757 A1 5/2012 Vrankovic et al.
2012/0127635 A1 5/2012 Grindeland
2012/0150455 A1 6/2012 Franklin et al.
2012/0152549 A1 6/2012 Koroteev
2012/0152716 A1 6/2012 Kikukawa et al.
2012/0205112 A1 8/2012 Pettigrew
2012/0205119 A1 8/2012 Wentworth
2012/0205301 A1 8/2012 McGuire et al.
2012/0205400 A1 8/2012 DeGaray et al.
2012/0222865 A1 9/2012 Larson
2012/0232728 A1 9/2012 Karimi et al.
2012/0247783 A1 10/2012 Berner, Jr.
2012/0255734 A1 10/2012 Coli
2013/0009469 A1 1/2013 Gillett
2013/0025706 A1 1/2013 DeGaray et al.
2013/0051971 A1 2/2013 Wyse et al.
2013/0064528 A1 3/2013 Bigex
2013/0175038 A1 7/2013 Conrad
2013/0175039 A1 7/2013 Guidry
2013/0180722 A1 7/2013 Olarte Caro
2013/0189629 A1 7/2013 Chandler
2013/0199617 A1 8/2013 DeGaray et al.
2013/0233542 A1 9/2013 Shampine
2013/0242688 A1 9/2013 Kageler
2013/0255271 A1 10/2013 Yu et al.
2013/0278183 A1 10/2013 Liang
2013/0284278 A1 10/2013 Winborn
2013/0284455 A1 10/2013 Kajaria et al.
2013/0299167 A1 11/2013 Fordyce
2013/0306322 A1 11/2013 Sanborn
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0041730 A1 2/2014 Naizer
2014/0054965 A1 2/2014 Jain
2014/0060658 A1 3/2014 Hains
2014/0095114 A1 4/2014 Thomeer
2014/0096974 A1 4/2014 Coli
2014/0124162 A1 5/2014 Leavitt
2014/0127036 A1 5/2014 Buckley
2014/0138079 A1 5/2014 Broussard et al.
2014/0147310 A1 5/2014 Hunt
2014/0174691 A1 6/2014 Kamps
2014/0174717 A1 6/2014 Broussard et al.
2014/0205475 A1 7/2014 Dale
2014/0219824 A1 8/2014 Burnette
2014/0238683 A1 8/2014 Korach
2014/0246211 A1 9/2014 Guidry et al.
2014/0251623 A1 9/2014 Lestz et al.
2014/0255214 A1 9/2014 Burnette
2014/0277772 A1 9/2014 Lopez
2014/0290768 A1 10/2014 Randle
2014/0332199 A1 11/2014 Gilstad
2014/0379300 A1 12/2014 Devine
2015/0027712 A1 1/2015 Vicknair
2015/0053426 A1 2/2015 Smith
2015/0068724 A1 3/2015 Coli et al.
2015/0068754 A1 3/2015 Coli et al.
2015/0075778 A1 3/2015 Walters
2015/0078924 A1 3/2015 Zhang
2015/0083426 A1 3/2015 Lesko
2015/0097504 A1 4/2015 Lamascus
2015/0114652 A1 4/2015 Lestz
2015/0136043 A1 5/2015 Shaaban
2015/0144336 A1 5/2015 Hardin et al.
2015/0147194 A1 5/2015 Foote
2015/0159911 A1 6/2015 Holt
2015/0175013 A1 6/2015 Cryer et al.
2015/0176386 A1 6/2015 Castillo et al.
2015/0211512 A1 7/2015 Wiegman
2015/0211524 A1 7/2015 Broussard
2015/0217672 A1 8/2015 Shampine
2015/0225113 A1 8/2015 Lungu
2015/0233530 A1 8/2015 Sandidge
2015/0252661 A1 9/2015 Glass
2015/0300145 A1 10/2015 Coli et al.
2015/0300336 A1 10/2015 Hernandez
2015/0314225 A1 11/2015 Coli et al.
2015/0330172 A1 11/2015 Allmaras
2015/0354322 A1 12/2015 Vicknair
2016/0006311 A1 1/2016 Li
2016/0032703 A1 2/2016 Broussard et al.

(56) References Cited

U.S. PATENT DOCUMENTS

2016/0102537 A1 4/2016 Lopez
2016/0105022 A1 4/2016 Oehring
2016/0208592 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208593 A1 7/2016 Coli et al.
2016/0208594 A1 7/2016 Coli et al.
2016/0208595 A1 7/2016 Tang
2016/0221220 A1 8/2016 Paige
2016/0230524 A1 8/2016 Dumoit
2016/0230525 A1 8/2016 Lestz et al.
2016/0230660 A1 8/2016 Zeitoun et al.
2016/0258267 A1 9/2016 Payne et al.
2016/0265457 A1 9/2016 Stephenson
2016/0273328 A1 9/2016 Oehring
2016/0273456 A1 9/2016 Zhang et al.
2016/0281484 A1 9/2016 Lestz
2016/0290114 A1 10/2016 Oehring
2016/0290563 A1 10/2016 Diggins
2016/0312108 A1 10/2016 Lestz et al.
2016/0319650 A1 11/2016 Oehring
2016/0326853 A1 11/2016 Fred et al.
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0016433 A1 1/2017 Chong
2017/0021318 A1 1/2017 McIver et al.
2017/0022788 A1 1/2017 Oehring et al.
2017/0022807 A1 1/2017 Dursun
2017/0028368 A1 2/2017 Oehring et al.
2017/0030177 A1 2/2017 Oehring et al.
2017/0030178 A1 2/2017 Oehring et al.
2017/0036178 A1 2/2017 Coli et al.
2017/0036872 A1 2/2017 Wallace
2017/0037717 A1 2/2017 Oehring
2017/0037718 A1 2/2017 Coli et al.
2017/0043280 A1 2/2017 Vankouwenberg
2017/0051732 A1 2/2017 Hemandez et al.
2017/0074076 A1* 3/2017 Joseph ..... G06Q 10/06312
2017/0082033 A1 3/2017 Wu et al.
2017/0096885 A1 4/2017 Oehring
2017/0096889 A1 4/2017 Blanckaert et al.
2017/0104389 A1 4/2017 Morris et al.
2017/0114625 A1 4/2017 Norris
2017/0130743 A1 5/2017 Anderson
2017/0138171 A1 5/2017 Richards et al.
2017/0145918 A1 5/2017 Oehring
2017/0146189 A1 5/2017 Herman
2017/0159570 A1 6/2017 Bickert
2017/0159654 A1 6/2017 Kendrick
2017/0175516 A1 6/2017 Eslinger
2017/0204852 A1 7/2017 Barnett
2017/0212535 A1 7/2017 Shelman et al.
2017/0218727 A1 8/2017 Oehring
2017/0218843 A1 8/2017 Oehring
2017/0222409 A1 8/2017 Oehring
2017/0226838 A1 8/2017 Ceizobka
2017/0226839 A1 8/2017 Broussard
2017/0226842 A1 8/2017 Omont et al.
2017/0234250 A1 8/2017 Janik
2017/0241221 A1 8/2017 Seshadri
2017/0259227 A1 9/2017 Morris et al.
2017/0292513 A1 10/2017 Haddad
2017/0302218 A1 10/2017 Janik
2017/0313499 A1 11/2017 Hughes et al.
2017/0314380 A1 11/2017 Oehring
2017/0314979 A1 11/2017 Ye
2017/0328179 A1 11/2017 Dykstra
2017/0369258 A1 12/2017 DeGaray
2017/0370639 A1 12/2017 Barden et al.
2018/0028992 A1 2/2018 Stegemoeller
2018/0038216 A1 2/2018 Zhang
2018/0045331 A1 2/2018 Lopez
2018/0090914 A1 3/2018 Johnson et al.
2018/0156210 A1 6/2018 Oehring
2018/0181830 A1 6/2018 Luharuka et al.
2018/0183219 A1 6/2018 Oehring
2018/0216455 A1 8/2018 Andreychuk
2018/0238147 A1 8/2018 Shahri
2018/0245428 A1 8/2018 Richards
2018/0258746 A1 9/2018 Broussard
2018/0259080 A1 9/2018 Dale et al.
2018/0266217 A1 9/2018 Funkhauser et al.
2018/0266412 A1 9/2018 Stokkevag
2018/0274446 A1 9/2018 Oehring
2018/0284817 A1 10/2018 Cook et al.
2018/0291713 A1 10/2018 Jeanson
2018/0298731 A1 10/2018 Bishop
2018/0312738 A1 11/2018 Rutsch et al.
2018/0313677 A1 11/2018 Warren et al.
2018/0320483 A1 11/2018 Zhang
2018/0343125 A1 11/2018 Clish
2018/0363437 A1 12/2018 Coli
2018/0363640 A1* 12/2018 Kajita ..... E21B 44/00
2018/0366950 A1 12/2018 Pedersen et al.
2019/0003329 A1 1/2019 Morris
2019/0010793 A1 1/2019 Hinderliter
2019/0040727 A1 2/2019 Oehring et al.
2019/0055827 A1 2/2019 Coli
2019/0063309 A1 2/2019 Davis
2019/0100989 A1 4/2019 Stewart
2019/0112910 A1 4/2019 Oehring
2019/0119096 A1 4/2019 Haile
2019/0120024 A1 4/2019 Oehring
2019/0128080 A1 5/2019 Ross
2019/0128104 A1 5/2019 Graham et al.
2019/0145251 A1 5/2019 Johnson
2019/0154020 A1 5/2019 Glass
2019/0162061 A1 5/2019 Stepheson
2019/0169971 A1 6/2019 Oehring
2019/0178057 A1 6/2019 Hunter
2019/0178235 A1 6/2019 Coskrey
2019/0203567 A1 7/2019 Ross
2019/0203572 A1 7/2019 Morris
2019/0211661 A1 7/2019 Reckels
2019/0226317 A1 7/2019 Payne et al.
2019/0245348 A1 8/2019 Hinderliter
2019/0249527 A1 8/2019 Kraynek
2019/0257462 A1 8/2019 Rogers
2019/0292866 A1 9/2019 Ross
2019/0292891 A1 9/2019 Kajaria
2020/0040878 A1 2/2020 Morris
2020/0047141 A1 2/2020 Oehring et al.
2020/0088152 A1* 3/2020 Alloin ..... F03B 15/10
2020/0194976 A1 6/2020 Benussi
2020/0232454 A1 7/2020 Chretien
2020/0325760 A1 10/2020 Markham
2020/0350790 A1 11/2020 Luft et al.

FOREIGN PATENT DOCUMENTS

CA 2158637 9/1994
CA 2406801 11/2001
CA 2653069 12/2007
CA 2707269 12/2010
CA 2482943 5/2011
CA 3050131 11/2011
CA 2773843 10/2012
CA 2845347 10/2012
CA 2955706 10/2012
CA 2966672 10/2012
CA 3000322 4/2013
CA 2787814 2/2014
CA 2833711 5/2014
CA 2978706 9/2016
CA 2944980 2/2017
CA 3006422 6/2017
CA 3018485 8/2017
CA 2964593 10/2017

(56) References Cited

FOREIGN PATENT DOCUMENTS

| | | | |
|---|---|---|---|
| CA | 2849825 | | 7/2018 |
| CA | 3067854 | A1 | 1/2019 |
| CA | 2919649 | | 2/2019 |
| CA | 2919666 | | 7/2019 |
| CA | 2797081 | | 9/2019 |
| CA | 2945579 | | 10/2019 |
| CN | 101639059 | | 2/2010 |
| CN | 101977016 | | 2/2011 |
| CN | 201730812 | | 2/2011 |
| CN | 201819992 | | 5/2011 |
| CN | 201925157 | | 8/2011 |
| CN | 202157824 | | 3/2012 |
| CN | 202406331 | | 8/2012 |
| CN | 202463670 | | 10/2012 |
| CN | 202500735 | | 10/2012 |
| CN | 202545207 | | 11/2012 |
| CN | 103095209 | | 5/2013 |
| CN | 104117308 | A | 10/2014 |
| CN | 102758604 | | 12/2014 |
| CN | 104196613 | A | 12/2014 |
| CN | 205986303 | U | 2/2017 |
| CN | 108049999 | A | 5/2018 |
| CN | 112196508 | A | 1/2021 |
| EP | 3453827 | | 3/2019 |
| EP | 3456915 | | 3/2019 |
| JP | 2004264589 | | 9/2004 |
| JP | 3626363 | | 3/2005 |
| JP | 2008263774 | | 10/2008 |
| JP | 2012-117371 | | 6/2012 |
| KR | 20100028462 | | 3/2010 |
| RU | 48205 | | 9/2005 |
| RU | 98493 | | 10/2010 |
| RU | 2421605 | | 6/2011 |
| WO | 93/20328 | | 10/1993 |
| WO | 98/53182 | | 11/1998 |
| WO | 2008/136883 | | 11/2008 |
| WO | 2009/023042 | | 2/2009 |
| WO | 2009046280 | | 4/2009 |
| WO | 2011/127305 | | 10/2011 |
| WO | 2012/122636 | | 9/2012 |
| WO | 2012/137068 | | 10/2012 |
| WO | 2014177346 | | 11/2014 |
| WO | 2016/144939 | | 9/2016 |
| WO | 2016/160458 | | 10/2016 |
| WO | 2018044307 | A1 | 3/2018 |
| WO | 2018213925 | A1 | 11/2018 |
| WO | 2019210417 | | 11/2019 |

OTHER PUBLICATIONS

Non-Final Office dated Oct. 5, 2020 in U.S. Appl. No. 16/443,273.
International Search Report and Written Opinion dated Aug. 28, 2020 in PCT/US20/23821.
Non-Final Office Action dated Sep. 2, 2020 in U.S. Appl. No. 16/356,263.
Non-Final Office Action dated Aug. 31, 2020 in U.S. Appl. No. 16/167,083.
Albone, "Mobile Compressor Stations for Natural Gas Transmission Service," ASME 67-GT-33, Turbo Expo, Power for Land, Sea and Air, vol. 79887, p. 1-10, 1967.
Canadian Office Action dated Sep. 22, 2020 in Canadian Application No. 2,982,974.
International Search Report and Written Opinion dated Sep. 3, 2020 in PCT/US2020/36932.
"Process Burner" (https://www.cebasrt.com/productsloii-gaslprocess-bumer) 06 Sep. 6, 2018 (Sep. 6, 2018), entire document, especially para (Burners for refinery Heaters].
Water and Glycol Heating Systems• (https://www.heat-inc.com/wg-series-water-glycol-systems/) Jun. 18, 2018 (Jun. 18, 2018), entire document, especially WG Series Water Glycol Systems.
"Heat Exchanger" (https://en.wiklpedia.org/w/index.php?title=Heat_exchanger&oldid=89300146) Dec. 18, 2019 Apr. 2019 (Apr. 18, 2019), entire document, especially para (0001].
Canadian Office Action dated Sep. 8, 2020 in Canadian Patent Application No. 2,928,707.
Canadian Office Action dated Aug. 31, 2020 in Canadian Patent Application No. 2,944,980.
Response to Non-Final Office Action dated Aug. 3, 2015 in related U.S. Appl. No. 13/679,689, 62 pages.
George E. King, "Hydraulic Fracturing 101: What Every Representative, Environmentalist, Regulator, Reporter, Investor, University Researcher, Neighbor and Engineer Should Know About Estimating Frac Risk and Improving Frac Performance in Unconventional Gas and Oil Wells," Feb. 6-8, 2012, Society of Petroleum Engineers, 80 pages.
Gardner Denver Pumps, GD2500Q Quintuplex Pump, Oct. 14, 2019, http://www.gardnerdenver.com/en-us/pumps/quintuplex-pump-gd-2500q#menu, 7 pages.
TMEIC, TMEIC Industrial Motors Manual, 2012, 12 pages.
Toshiba, Toshiba Q9 ASD Installation and Operation Manual, Apr. 2010, 233 pages.
ABB, ABB drives in power generation: medium voltage drives for more efficient and reliable plant operation, 2006, 12 pages.
ABB, Industry Brochure—ABB drives in chemical, oil and gas medium voltage drives for greater profitability and performance, 2009, 16 pages.
ABB, ABB drives in chemical, oil and gas Medium voltage drives for greater profitability and performance, 2011, 16 pages.
ABB, Drive PC Tools: Startup and maintenance, DriveWindow Light, 2014, 2 pages.
ABB, Global Center of Excellence DC Drives: DriveWindow light upgrade for DC drives Used for DWL 2.95 and DC DriveAP, Dec. 4, 2018, 1 page.
ABB, ABB Drive Ware User's Manual, DriveWindow 2, Dec. 31, 2012, 604 pages.
ABB, ABB Drive Ware User's Guide, DriveWindow Light 2, Oct. 15, 2013, 45 pages.
Warren Electric Corp., Hydraulic heaters maintain fluid quality and consistency, Hydraulics & Pneumatics, Dec. 30, 2010, 12 pages.
Onyx Industries Inc., Stack Light Engineering Reference Guide, Sep. 23, 2012, 4 pages.
Borets, "Borets Oil Equipment," accessed Sep. 4, 2020, 158 pages.
Andrew Howard Nunn, "The feasibility of natural gas as a fuel source for modern land-based drilling," Dec. 2011, 94 pages.
R. Saidur, "Applications of variable speed drive (VSD) in electrical motors energy savings," 2012, vol. 16, pp. 543-550.
Discenzo, "Next Generation Pump Systems Enable New Opportunities for Asset Management and Economic Optimization," accessed Sep. 4, 2020, 8 pages.
Nikolich, "Compressors, pumps, refrigeration equipment: improvement and specialization of piston pumps for oil and gas well-drilling and production operations," 1996, Chemical and Petroleum Engineering, vol. 32, pp. 157-162.
Finger, "Sandia National Handbook Laboratories Report: Slimhole handbook: procedures and recommendations for slimhole drilling and testing in geothermal exploration," Oct. 1999, 164 pages.
Steve Besore, MTU Detroit Diesel Inc., "How to select generator sets for today's oil and gas drill rigs: careful comparison and selection can improve performance and reduce costs," May 5, 2010, 4 pages, https://www.mtu-online.com/fileadmin/fm-dam/mtu-usa/mtuinnorthamerica/white-papers/WhitePaper_EDP.pdf.
Pemberton, "Strategies for Optimizing pump efficiency and LCC performance: process pumps are the largest consumers of energy in a typical pulp and paper mill—boosting their efficiency is a new avenue to reduced plant operating costs," Jun. 2003, Paper Age, pp. 28-32.
Robert B. Thompson, "Optimizing the production system using real-time measurements: a piece of the digital oilfield puzzle," Nov. 11-14, 2007, SPE Annual Technical Conference and Exhibition, Anaheim, CA, pp. 1-10.
Guffey, "Field testing of variable-speed beam-pump computer control," May 1991, SPE Production Engineering, pp. 155-160.
Irvine, "The use of variable frequency drives as a final control in the petroleum industry," 2000, IEEE, pp. 2749-2758.

(56) References Cited

OTHER PUBLICATIONS

R. Ikeda et al., "Hydraulic fracturing technique: pore pressure effect and stress heterogeneity," 1989, Int. J. Rock Mech. Min. Sci. & Geomech., vol. 26, No. 6, pp. 471-475.
Coli Patent Application, "Mobile, modular, electrically powered system for use in fracturing underground formations," filed Apr. 7, 2011, 28 pages.
Gardner Denver—Well Servicing Pump Model GD-2500Q, GD-2500Q-HD, Quintuplex Pumps, GWS Fluid End Parts List, Jul. 2011, 39 pages.
Gardner Denver GD-2500Q Well Service Pump, 2 pages.
Gardner Denver C-2500 Quintuplex Well Service Pump, 2013, 2 pages.
Toshiba 2011 Industrial Catalog, Drives, PAC, PLCs, 2011, 272 pages.
Gardner Denver GD-2500 Quintuplex Well Service Pump, 2003, 2 pages.
Gardner Denver GD-2500Q Quintuplex Well Service Pump Operating and Service Manual, Aug. 2005, 46 pages.
Gardner Denver GD-2500Q Quintuplex Well Service Pump Power End Parts List, Apr. 2007, 15 pages.
Toshiba H9 ASD Installation and Operation Manual, Mar. 2011, 287 pages.
Offshore Technology Conference, Houston, TX, Apr. 30-May 3, 2012, Honghua Group Brochure and Pictures, 6 pages.
Honghua Group Customer Spreadsheet, 2 pages.
Charlotte Owen, "Chinese company launches new fracking rigs," May 2, 2012, Oil & Gas Technology Magazine, 2 pages.
Honghua Group Limited, Complete Equipment and System Integrating by Using of Gas Power-gen and Power Grid and VFD System, 30 pages.
Honghua Group Limited, Is gas and electricity driven equipment the future trend for develop lithologic reservoirs, 2 pages.
ABB Group, MV Drive benefits for shale gas applications, Powerpoint, Apr. 2012, 16 pages.
U.S. Well Services, Game-changing hydraulic fracturing technology, reduces emissions by 99%: U.S. Well Services's patented clean fleet technology proven to cut emission, save fuel and allow for quieter operations on site, Oct. 1, 2014, 3 pages.
Asme, Hydraulic Fracturing's Greener Tint, Jan. 11, 2018, 2 pages.
Fluid Power, Clean Fleet Reduces Emissions by 99% at Hydraulic Fracturing Sites, Jan. 11, 2005, 3 pages.
Louisiana State University, Petroleum alumnus and team develop mobile fracturing unit that alleviates environmental impact, LSU School of EE & CS, Nov. 2012, 2 pages.
Linda Kane, Energy pipeline: US Well Services brings clean fleet to Weld County, Nov. 4, 2015, Greeley Tribute, 7 pages.
Business Wire, Hunghua Group showcases shale gas, offshore and land drilling solutions at the 2013 Offshore Technology Conference, May 6, 2013, 2 pages.
Joanne Liou, Hunghua Group introduces 6,000-hp integrated shale gas system, Drilling Matters, May 21, 2012, 2 pages.
TESS Record—Trademark for Clean Fleet registered Sep. 5, 2013, accessed Jan. 14, 2020, 2 pages.
U.S. Well Services, About U.S. Well Services, accessed Jan. 14, 2020, 14 pages.
Unknown, "Improving the Drilling Cycle," Oilfield Technology, Dec. 2009, vol. 2, Issue 9, 5 pages.
Unknown, "Andon (manufacturing)," last edited Sep. 8, 2019, https://en.wikipedia.org/w/index.php?title=Andon_(manufacturing)&oldid=914575778, 2 pages.
S.K. Subramaniam, "Production monitoring system for monitoring the industrial shop floor performance," 2009, International Journal of Systems Applications, Engineering & Development, vol. 3, Issue 1, pp. 28-35.
Unknown, Evolution Well Services advances fracturing operations with an electrically powered system,Calgary PR Newswire, Jun. 4, 2012, 2 pages.
Honghua Group, Honghua America, LLC, HHF—1600 Mud Pump, 2 pages.
Honghua Group, Honghua Shale Gas Solutions Power Point Slides, Feb. 2012, 41 pages.
Mactel, Frac Test with VFDs Final Report Hydraulic Fracturing Pilot Test Results and Preliminary Full Scale Design United Nuclear Church Rock Facility, Dec. 23, 2003, 73 pages.
Jon Gates, ASME Hydraulic Fracturing Conference, Mar. 24, 2015, http://www.otrglobal.com/newsroom/cnotes/128720, 6 pages.
Gardner Denver Well Servicing Pump Model C2500Q Quintuplex Operating and Service Manual, Apr. 2011, 46 pages.
Coli, Mobile, modular, electrically powered system for use in fracturing underground formations using liquid petroleum gas, Oct. 5, 2012, U.S. Appl. No. 61/710,393, 59 pages.
Toshiba, G9 Brochure—G9 Series Adjustable Speed Drives, Jun. 2007, 6 pages.
Luis Gamboa, "Variable Frequency Drives in Oil and Gas Pumping Systems," Pumps & Systems, Dec. 17, 2011, https://www.pumpsandsystems.com/variable-frequency-drives-oil-and-gas-pumping-systems, 5 pages.
Unknown, "U.S. Well Services for Antero Fracking," Oct. 3, 2014, HHP Insight, http://hhpinsight.com/epoperations/2014/10/u-s-well-services-for-antero-fracking/, 3 pages.
Stuart H. Loewenthal, Design of Power-Transmitting Shafts, NASA Reference Publication 1123, Jul. 1984, 30 pages.
International Search Report and Written Opinion mailed in PCT/US20/67526 dated May 6, 2021.
International Search Report and Written Opinion mailed in PCT/US20/67608 dated Mar. 30, 2021.
International Search Report and Written Opinion mailed in PCT/US20/67528 dated Mar. 19, 2021.
International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.
UK Power Networks—Transformers to Supply Heat to Tate Modern—from Press Releases May 16, 2013.
Non-Final Office Action issued in corresponding U.S. Appl. No. 15/293,681 dated Feb. 16, 2017.
Non-Final Office Action issued in corresponding U.S. Appl. No. 15/294,349 dated Mar. 14, 2017.
Final Office Action issued in corresponding U.S. Appl. No. 15/145,491 dated Jan. 20, 2017.
Non-Final Office Action issued in corresponding U.S. Appl. No. 15/145,443 dated Feb. 7, 2017.
Notice of Allowance issued in corresponding U.S. Appl. No. 15/217,040 dated Mar. 28, 2017.
Notice of Allowance issued in corresponding U.S. Appl. No. 14/622,532 dated Mar. 27, 2017.
Non-Final Office Action issued in corresponding U.S. Appl. No. 15/291,842 dated Jan. 6, 2017.
Final Office Action issued in corresponding U.S. Appl. No. 14/622,532 dated Dec. 7, 2016.
Non-Final Office Action issued in corresponding U.S. Appl. No. 14/622,532 dated May 17, 2016.
Final Office Action issued in corresponding U.S. Appl. No. 14/622,532 dated Dec. 21, 2015.
Non-Final Office Action issued in corresponding U.S. Appl. No. 14/622,532 dated Aug. 5, 2015.
Non-Final Office Action issued in corresponding U.S. Appl. No. 15/145,491 dated Sep. 12, 2016.
Non-Final Office Action issued in corresponding U.S. Appl. No. 15/217,040 dated Nov. 29, 2016.
Non-Final Office Action issued in corresponding U.S. Appl. No. 15/235,788 dated Dec. 14, 2016.
Non-Final Office Action issued in corresponding U.S. Appl. No. 15/145,491 dated May 15, 2017.
Non-Final Office Action issued in corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.

(56) References Cited

OTHER PUBLICATIONS

Final Office Action issued in corresponding U.S. Appl. No. 15/294,349 dated Jul. 6, 2017.
Non-Final Office Action issued in corresponding U.S. Appl. No. 14/884,363 dated Sep. 5, 2017.
Final Office Action issued in corresponding U.S. Appl. No. 15/145,491 dated Sep. 6, 2017.
Non-Final Office Action issued in corresponding U.S. Appl. No. 14/881,535 dated Oct. 6, 2017.
Non-Final Office Action issued in corresponding U.S. Appl. No. 15/145,414 dated Nov. 29, 2017.
Non-Final Office Action issued in corresponding U.S. Appl. No. 15/644,487 dated Nov. 13, 2017.
Canadian Office Action dated Mar. 2, 2018 in related Canadian Patent Application No. 2,833,711.
Office Action dated Apr. 10, 2018 in related U.S. Appl. No. 15/294,349.
Office Action dated Apr. 2, 2018 in related U.S. Appl. No. 15/183,387.
Office Action dated May 29, 2018 in related U.S. Appl. No. 15/235,716.
Candian Office Action dated Apr. 18, 2018 in related Canadian Patent Application No. 2,928,711.
Canadian Office Action dated Jun. 22, 2018 in related Canadian Patent Application No. 2,886,697.
Cffice Action dated Jul. 25, 2018 in related U.S. Appl. No. 15/644,487.
Office Action dated Oct. 4, 2018 in related U.S. Appl. No. 15/217,081.
International Search Report and Written Opinion dated Sep. 19, 2018 in related PCT Patent Application No. PCT/US2018/040683.
Canadian Office Action dated Sep. 28, 2018 in related Canadian Patent Application No. 2,945,281.
Office Action dated Dec. 12, 2018 in related U.S. Appl. No. 16/160,708.
International Search Report and Written Opinion dated Jan. 2, 2019 in related PCT Patent Application No. PCT/US18/54542.
International Search Report and Written Opinion dated Jan. 2, 2019 in related PCT Patent Application No. PCT/US18/54548.
International Search Report and Written Opinion dated Dec. 31, 2018 in related PCT Patent Application No. PCT/US18/55913.
International Search Report and Written Opinion dated Jan. 4, 2019 in related PCT Patent Application No. PCT/US18/57539.
Non-Final Office Action dated Feb. 12, 2019 in related U.S. Appl. No. 16/170,695.
International Search Report and Written Opinion dated Feb. 15, 2019 in related PCT Patent Application No. PCT/US18/63977.
International Search Report and Written Opinion dated Mar. 5, 2019 in related PCT Patent Application No. PCT/US18/63970.
Non-Final Office Action dated Feb. 25, 2019 in related U.S. Appl. No. 16/210,749.
Non-Final Office Action dated Mar. 6, 2019 in related U.S. Appl. No. 15/183,387.
Office Action dated Jan. 30, 2019 in related Canadian Patent Application No. 2,936,997.
Office Action dated Mar. 1, 2019 in related Canadian Patent Application No. 2,943,275.
International Search Report and Written Opinion dated Apr. 10, 2019 in corresponding PCT Application No. PCT/US2019/016635.
Notice of Allowance dated Apr. 23, 2019 in corresponding U.S. Appl. No. 15/635,028.
International Search Report and Written Opinion dated Jul. 9, 2019 in corresponding PCT Application No. PCT/US2019/027584.
Morris et al., U.S. Appl. No. 62/526,869; Hydration-Blender Transport and Electric Power Distribution for Fracturing Operation; Jun. 28, 2018; USPTO; see entire document.
Final Office Action dated Feb. 4, 2021 in U.S. Appl. No. 16/597,014.
International Search Report and Written Opinion dated Feb. 4, 2021 in PCT/US20/59834.
International Search Report and Written Opinion dated Feb. 2, 2021 in PCT/US20/58906.
International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.
International Search Report and Written Opinion dated Nov. 24, 2020 in corresponding PCT Application No. PCT/US20/44274.
Non-Final Office Action issued in corresponding U.S. Appl. No. 16/170,695 dated Jun. 7, 2019.
Non-Final Office Action issued in corresponding U.S. Appl. No. 16/268,030 dated May 10, 2019.
Final Office Action issued in corresponding U.S. Appl. No. 16/210,749 dated Jun. 11, 2019.
Canadian Office Action dated May 30, 2019 in corresponding CA Application No. 2,833,711.
Canadian Office Action dated Jun. 20, 2019 in corresponding CA Application No. 2,964,597.
International Search Report and Written Opinion dated Jul. 9, 2019 in related PCT Application No. PCT/US2019/027584.
Office Action dated Jun. 7, 2019 in related U.S. Appl. No. 16/268,030.
International Search Report and Written Opinion dated Sep. 11, 2019 in related PCT Application No. PCT/US2019/037493.
Office Action dated Aug. 19, 2019 in related U.S. Appl. No. 15/356,436.
Office Action dated Oct. 2, 2019 in related U.S. Appl. No. 16/152,732.
Office Action dated Sep. 11, 2019 in related U.S. Appl. No. 16/268,030.
Office Action dated Oct. 11, 2019 in related U.S. Appl. No. 16/385,070.
Office Action dated Sep. 3, 2019 in related U.S. Appl. No. 15/994,772.
Office Action dated Sep. 20, 2019 in related U.S. Appl. No. 16/443,273.
Canadian Office Action dated Oct. 1, 2019 in related Canadian Patent Application No. 2,936,997.
International Search Report and Written Opinion dated Nov. 26, 2019 in related PCT Application No. PCT/US19/51018.
Office Action dated Dec. 6, 2019 in related U.S. Appl. No. 16/564,186.
International Search Report and Written Opinion dated Jan. 2, 2020 in related PCT Application No. PCT/US19/55325.
Notice of Allowance dated Jan. 9, 2020 in related U.S. Appl. No. 16/570,331.
Non-Final Office Action dated Dec. 23, 2019 in related U.S. Appl. No. 16/597,008.
Non-Final Office Action dated Mar. 3, 2020 in related U.S. Appl. No. 16/152,695.
International Search Report and Written Opinion dated Feb. 11, 2020 in related PCT Application No. PCT/US2019/055323.
Final Office Action dated Mar. 31, 2020 in related U.S. Appl. No. 15/356,436.
Non-Final Office Action dated May 20, 2020 in related U.S. Appl. No. 14/881,535.
Non-Final Office Action dated May 8, 2020 in related U.S. Appl. No. 15/145,443.
Non-Final Office Action dated May 22, 2020 in related U.S. Appl. No. 16/458,696.
International Search Report and Written Opinion dated Jun. 2, 2020 in related PCT Application No. PCT/US20/23809.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines.
Goodwin, "High-voltage auxiliary switchgear for power stations," Power Engineering Journal, 1989, 10 pg.
International Search Report and Written Opinion dated Jun. 23, 2020 in corresponding PCT Application No. PCT/US20/23912.
International Search Report and Written Opinion dated Jul. 22, 2020 in corresponding PCT Application No. PCT/US20/00017.
Office Action dated Aug. 4, 2020 in related U.S. Appl. No. 16/385,070.
Office Action dated Jun. 29, 2020 in related U.S. Appl. No. 16/404,283.

(56) References Cited

OTHER PUBLICATIONS

Office Action dated Jun. 29, 2020 in related U.S. Appl. No. 16/728,359.
Office Action dated Jun. 22, 2020 in related U.S. Appl. No. 16/377,861.
Canadian Office Action dated Aug. 18, 2020 in related CA Patent Application No. 2,933,444.
Canadian Office Action dated Aug. 17, 2020 in related CA Patent Application No. 2,944,968.
Office Action dated Jul. 23, 2020 in related U.S. Appl. No. 16/597,014.
Non-Final Office Action issued in U.S. Appl. No. 16/871,928 dated Aug. 25, 2021.
Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Woodbury et al., "Electrical Design Considerations for Drilling Rigs," IEEE Transactions on Industry Applications, vol. 1A-12, No. 4, Jul./Aug. 1976, pp. 421-431.
Kroposki et al., Making Microgrids Work, 6 IEEE Power and Energy Mag. 40, 41 (2008).
Dan T. Ton & Merrill A. Smith, The U.S. Department of Energy's Microgrid Initiative, 25 the Electricity J. 84 (2012), pp. 84-94.
Non-Final Office Action issued in U.S. Appl. No. 16/871,328 dated Dec. 9, 2021.
Non-Final Office Action issued in U.S. Appl. No. 16/943,935 dated Oct. 21, 2021.
Non-Final Office Action issued in U.S. Appl. No. 16/564,186, dated Oct. 15, 2021.
Final Office Action issued in U.S. Appl. No. 16/356,263 dated Oct. 7, 2021.
Non-Final Office Action issued in U.S. Appl. No. 17/060,647 dated Sep. 20, 2021.
Non-Final Office Action issued in U.S. Appl. No. 16/901,774 dated Sep. 14, 2021.
Canadian Office Action issued in Canadian Application No. 3,094,768 dated Oct. 28, 2021.

* cited by examiner

HIGH CAPACITY POWER STORAGE SYSTEM FOR ELECTRIC HYDRAULIC FRACTURING

CROSS REFERENCE TO RELATED APPLICATIONS

This application claims priority to and the benefit of, U.S. Provisional Application Ser. No. 62/881,714, filed Aug. 1, 2019, the full disclosure of which is hereby incorporated herein by reference in its entirety for all purposes.

BACKGROUND

1. Field of Invention

This invention relates in general to equipment used hydraulic fracturing operations, and in particular, to electricity storage at a hydraulic fracturing site.

2. Description of the Prior Art

Hydraulic Fracturing is a technique used to stimulate production from some hydrocarbon producing wells. The technique involves injecting hydraulic fracturing fluid into a wellbore at a pressure sufficient to generate fissures in the formation surrounding the wellbore. Hydrocarbons can then flow through the fissures to a production bore. The hydraulic fracturing fluid is typically injected into the wellbore using hydraulic fracturing pumps, which can be powered, in some cases, by electric motors. The electric motors can in turn be powered by generators.

Preserving and extending the life and durability of power generators at an electric hydraulic fracturing site is a priority. This objective, however, can be undermined by overloading power generation equipment. Such overloading reduces the life span of the equipment, and can also create a hazardous environment at a wellsite due to malfunctions and overheating in close proximity with other hydraulic fracturing equipment.

The fast response electricity storage system of the present technology is one viable option to assisting in power distribution, in particular at times when power generation equipment is overloaded. Not only does such a system provide a rapid and effective way to supply power when demand is high, but it also possesses other features that help provide continuous reliable power to hydraulic fracturing equipment.

SUMMARY

One embodiment of the present technology provides a hydraulic fracturing power system, including a power source, a power storage system, and electric powered hydraulic fracturing equipment in selective electrical communication with the power source, the power storage system, or both. The system further includes at least one circuit breaker between the power source, the power storage system, or both, and the electric powered hydraulic fracturing equipment, the circuit breaker having an open position that opens an electric circuit between the electric powered hydraulic fracturing equipment and the power source, the power storage system, or both, and a closed position that closes the electric circuit.

In some embodiments, the power storage system can be at least one solid state battery selected from the group consisting of electrochemical capacitors, lithium ion batteries, nickel-cadmium batteries, and sodium sulfur batteries. Alternatively, the power storage system can be at least one flow battery selected from the group consisting of redox batteries, iron-chromium batteries, vanadium redox batteries, and zinc-bromine batteries. The at least one battery can be rechargeable.

In certain embodiments, the at least one circuit breaker can include a first circuit breaker and a second circuit breaker, the first circuit breaker electrically connected to the power source, and the second circuit breaker electrically connected to the power storage system. Each of the first circuit breaker and the second circuit breaker can be electrically connected to the electric powered hydraulic fracturing equipment via a common bus. Alternatively, the at least one circuit breaker can be a first circuit breaker, and both the power source and the power storage system can be electrically connected to the first circuit breaker.

In some embodiments, at least one of the power source and the power storage system can be electrically connected to the at least one circuit break via a power line. In addition, the power storage system can be mounted on a trailer. Furthermore, the at least one circuit breaker can be substantially enclosed in a switchgear housing.

Another embodiment of the present technology provides a system for powering electric hydraulic fracturing equipment, the system including a power storage system, electric powered hydraulic fracturing equipment in selective electrical communication with the power storage system, and at least one circuit breaker between the power storage system and the electric powered hydraulic fracturing equipment, the circuit breaker configured to facilitate or prevent electrical communication between the power storage system and the electric powered hydraulic fracturing equipment.

In certain embodiments, the power storage system can be at least one solid state battery selected from the group consisting of electrochemical capacitors, lithium ion batteries, nickel-cadmium batteries, and sodium sulfur batteries. Alternatively, the power storage system can be at least one flow battery selected from the group consisting of redox batteries, iron-chromium batteries, vanadium redox batteries, and zinc-bromine batteries.

In addition, certain embodiments of the technology can also include a power source. In such embodiments, the at least one circuit breaker can include a first circuit breaker and a second circuit breaker, the first circuit breaker electrically connected to the power source, and the second circuit breaker electrically connected to the power storage system. Alternatively, the at least one circuit breaker can be a first circuit breaker, and wherein both the power source and the power storage system are electrically connected to the first circuit breaker.

Some embodiments can include a power source, wherein at least one of the power source and the power storage system are electrically connected to the at least one circuit breaker via a power line, and wherein the at least one circuit breaker is substantially enclosed in a switchgear housing. Furthermore, the power source can be rechargeable. Alternatively, the power source can be electrically connected to the at least one circuit breaker via a power line, and the power storage system can be located adjacent the switchgear housing and electrically coupled directly to the switchgear without a power line.

Additionally, yet another embodiment can include software in communication with the power storage system, the software configured to monitor the state of the power storage system and to integrate control of the power storage system with other features of the system for powering electric hydraulic fracturing equipment.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1A:
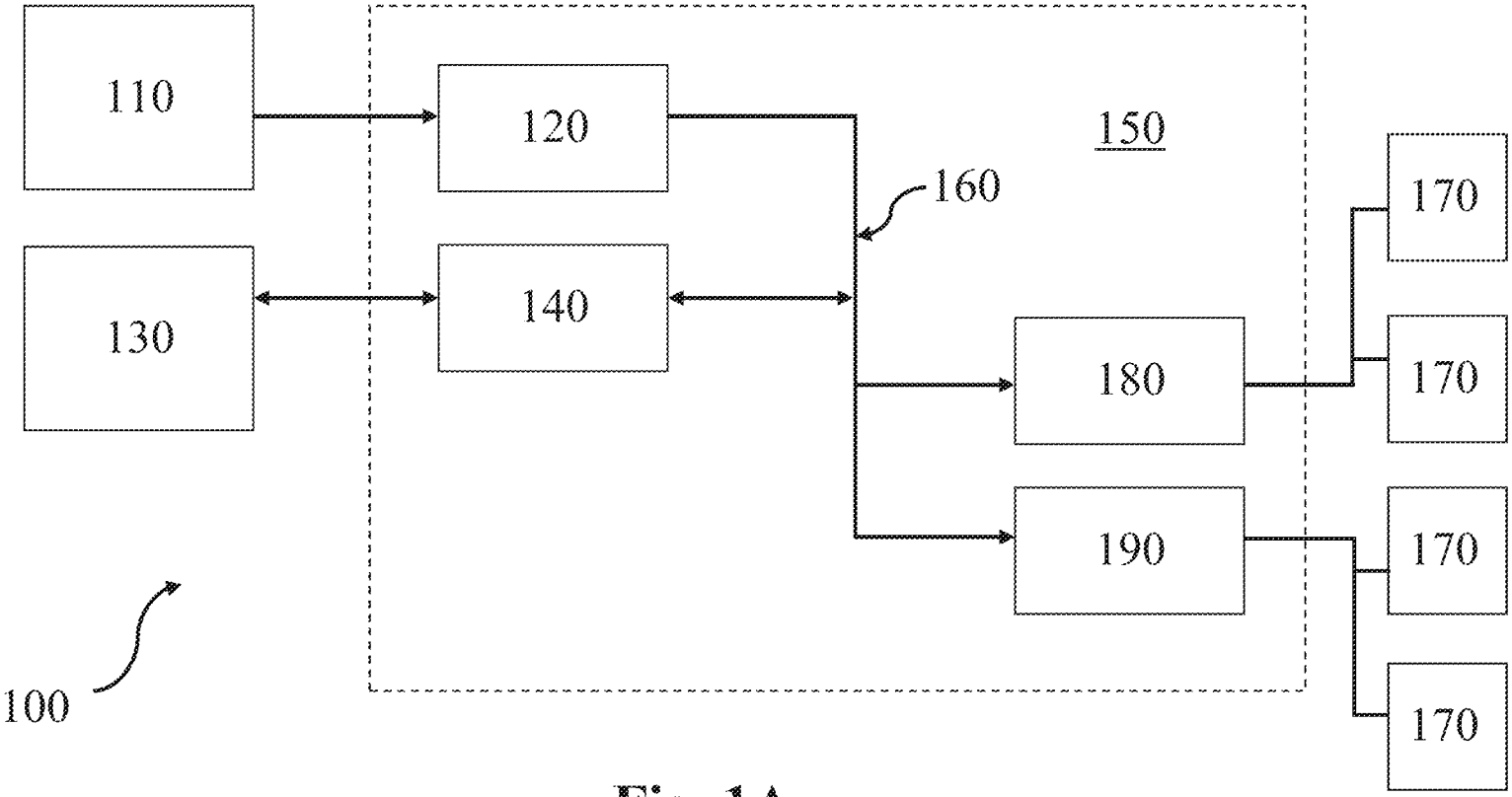
FIG. 1A is a schematic diagram of a hydraulic fracturing power system according to an embodiment of the present technology.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The invention, however, is not intended to be limited to the specific terms used, and it is to be understood that each specific term includes equivalents that operate in a similar manner to accomplish a similar purpose.

According to one embodiment of the technology, a fast response electricity storage, or power storage system (PSS) can be provided to supply power to the power generation equipment of an electric hydraulic fracturing fleet when demand is high or in the event of a generator failure. The PSS system can include either solid state batteries or flow batteries. Solid state batteries can include, for example, electrochemical capacitors, lithium ion batteries, nickel-cadmium batteries, and sodium sulfur batteries. In addition, solid state batteries can charge or discharge based on electricity usage, and such charging and discharging can be paired with a software system, to monitor the state of the batteries and control the charging and discharging of the batteries. Flow batteries can, for example, include redox, iron-chromium, vanadium redox, and zinc-bromine batteries, and can be rechargeable batteries that store electricity directly in an electrolyte solution and respond quickly as needed. The flow batteries can also be paired with software, and the software associated with the both solid state and flow batteries can be designed to integrate with an operator's existing system so that monitoring and control can be integrated with other functions.

FIG. 1A shows a hydraulic fracturing power system 100 according to an embodiment of the present technology. The hydraulic fracturing power system 100 includes a power source 110, which can be, for example, a generator, and which can feed a first circuit breaker 120. As shown, the hydraulic fracturing power system 100 can further include a PSS 130 that can feed a second circuit breaker 140. In some embodiments, both the first circuit breaker 120 and the second circuit breaker 140 can be housed in the same switchgear housing 150, or trailer. Both the first circuit breaker 120 and the second circuit breaker 140 can be connected to a common bus 160, which in some embodiments can be a large copper bar used to share power evenly to downstream equipment from upstream generators.

When the power source 110 is energized with both the first and second breakers 120, 140 closed, hydraulic fracturing equipment 170 can be supplied power while the PSS 130 stores excess electricity. The hydraulic fracturing equipment can be hydraulic fracturing pumps, blenders data vans, wireline equipment, boost pumps, cranes, lighting, chemical trailers, etc. Once load requirements increase for the equipment 170, the PSS 130 can release its stored power onto the common bus 160 in order to reduce the load on the power source 110. The power source 110 and the PSS 130 can share the burden of supplying power during stages of high power demand until the end of the fracturing stage. Before the next fracturing stage begins, the PSS 130 can replenish stored electricity used previously until it is needed to discharge its power. This ability to recharge and discharge intermittently or continuously as needed ensures adequate power distribution to the system by the PSS 130 throughout an operation.

Also shown in FIG. 1A are third circuit breaker 180 and fourth circuit breaker 190. Each of the third and fourth circuit breakers 180, 190 can be electrically connected to equipment 170. In the embodiment shown in FIG. 1A, each of the third and fourth circuit breakers 180, 190 are shown connected to pieces of equipment 170, such as, for example, two hydraulic fracturing pumps. In practice, however, the present technology contemplates any appropriate ratio of circuit breakers to equipment, including connecting each circuit breaker to a single piece of equipment, or connecting each circuit breaker to more than two pieces of equipment.

One advantage to the present technology is that it is a more efficient way of providing power at peak times than known systems, such as simply providing another generator on site. In addition, the entire PSS package can be much smaller than a second generator, thereby taking up less space on a pad. The storage system will also require significantly less rig up time due to having no fuel connections, crane lifts, or mechanical alignments.

Figure 1B:
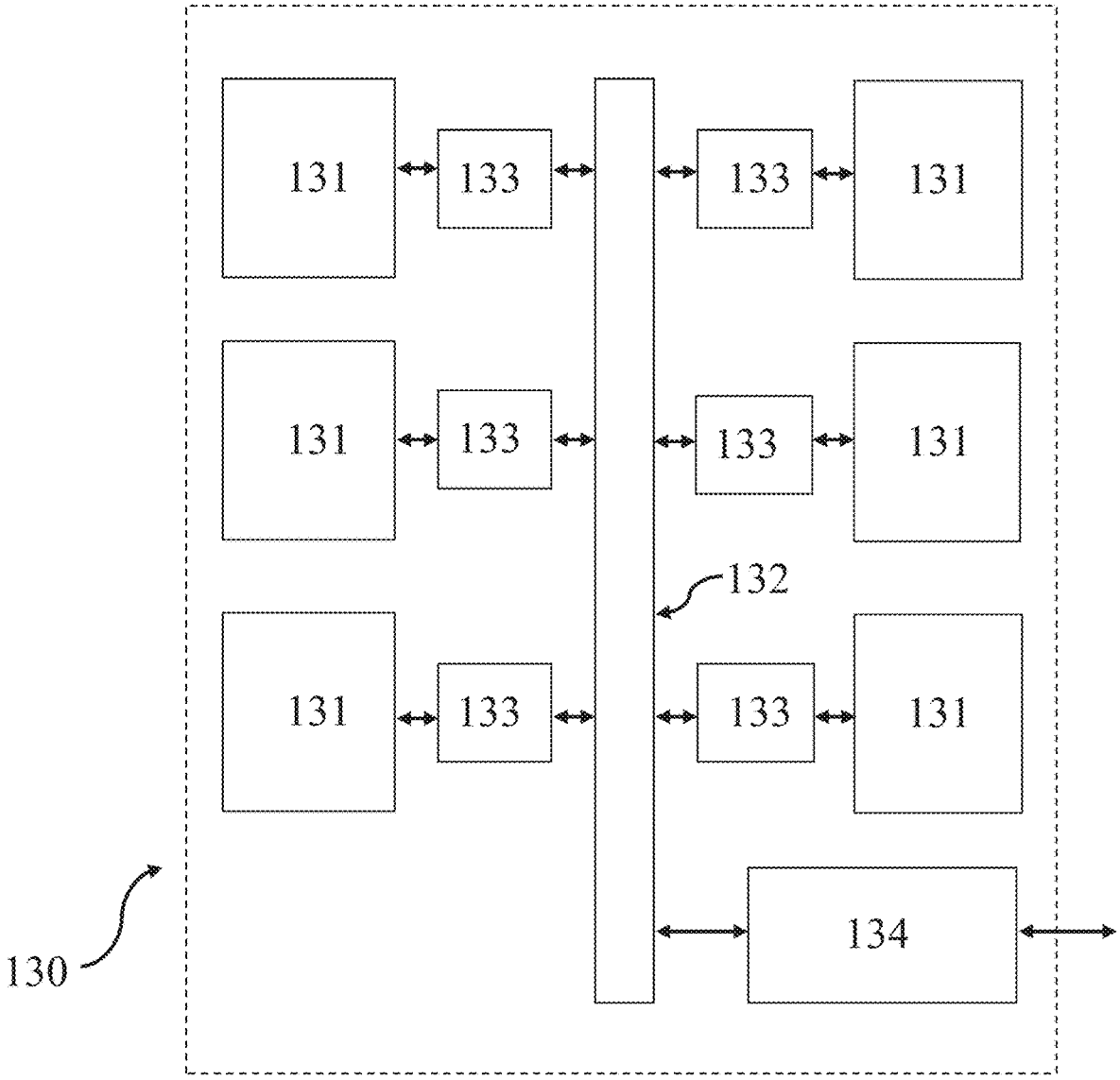
FIG. 1B is a schematic diagram of a power storage system as used in the embodiment of the hydraulic fracturing power system of FIG. 1A.

FIG. 1B is a schematic depiction of the PSS 130 of the embodiment of the hydraulic fracturing power system 100 of FIG. 1A. The PSS 130 can include a plurality of battery banks 131, each connected to a common PSS bus 132 via an optional battery bank circuit breaker 133. The common PSS bus 132 is also connected to a PSS circuit breaker 134 which is in turn electrically connected to circuit breaker 140 in the switchgear housing 150.

Each of the connections in the PSS 130—between the battery banks 131 and battery bank circuit breakers 133, the battery bank circuit breakers 133 and the common PSS bus 132, the common PSS bus 132 and the PSS circuit breaker 134, and the PSS circuit breaker 134 and the second circuit breaker 140—are two way connections, as indicated by double headed arrows. This means that electricity flows in both directions between the various components. One advantage to this configuration is the ability of the battery banks 131 within the PSS 130 to constantly discharge and recharge as needed or allowed by the load demands of the system. Thus, when a heavy load is required, the PSS 130 can augment the power provided by power source 110 to help avoid overloading power source 110. Conversely, when a light load is required, the PSS 130 can pull excess power from power source 110 to recharge battery banks 131.

Figure 2A:
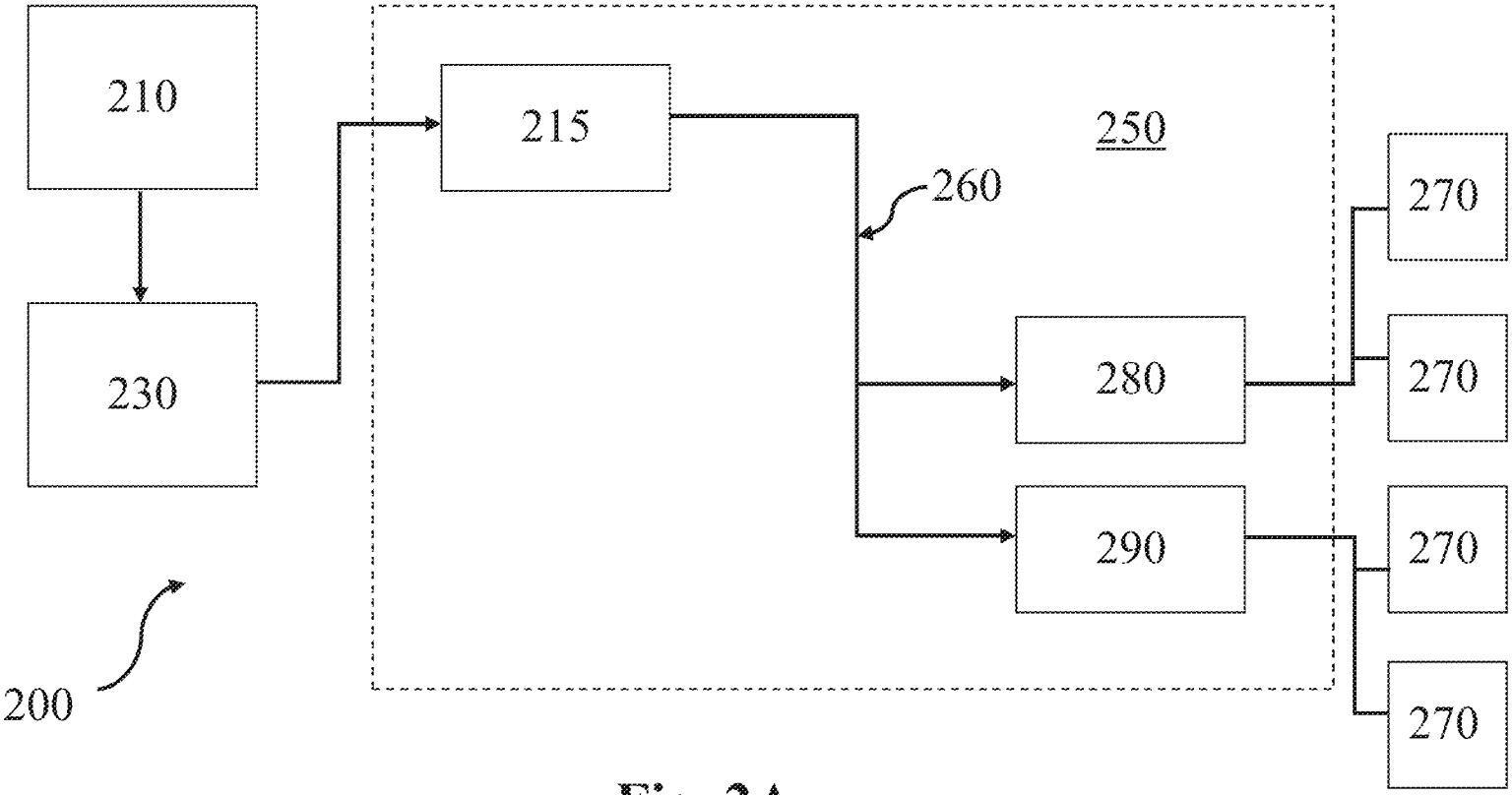
FIG. 2A is a schematic diagram of a hydraulic fracturing power system according to an alternate embodiment of the present technology.

Referring now to FIG. 2A, there is shown an alternate hydraulic fracturing power system 200 according to an alternate embodiment of the present technology, including a power source 210 and a PSS 230. According to FIG. 2, the PSS 230 can be connected to the power source 210 in series before feeding power to a circuit breaker 215 in the switchgear housing 250. Upon reaching full capacity, the PSS 230 can disconnect internal batteries from the power source 210, thereby allowing it to bypass straight to the switchgear system.

In the configuration shown in FIG. 2A, the circuit breaker 215 will then act as a feeder breaker for two additional circuit breakers 280, 290. As shown, the circuit breaker 215 can be connected to circuit breakers 280, 290 via common bus 260. Circuit breaker 215 can be rated for higher amperage than circuit breakers 280, 290. Circuit breakers 280, 290 are in turn connected to hydraulic fracturing equipment 270. Each of the additional circuit breakers 280, 290 can be electrically connected to equipment 270. In the embodiment shown in FIG. 2A, each of the additional circuit breakers 280, 290 are shown connected to two pieces of equipment 270, such as, for example, two hydraulic fracturing pumps. In practice, however, the present technology contemplates any appropriate ratio of circuit breakers to equipment, including connecting each circuit breaker to a single piece of equipment, or connecting each circuit breaker to more than two pieces of equipment.

Figure 2B:
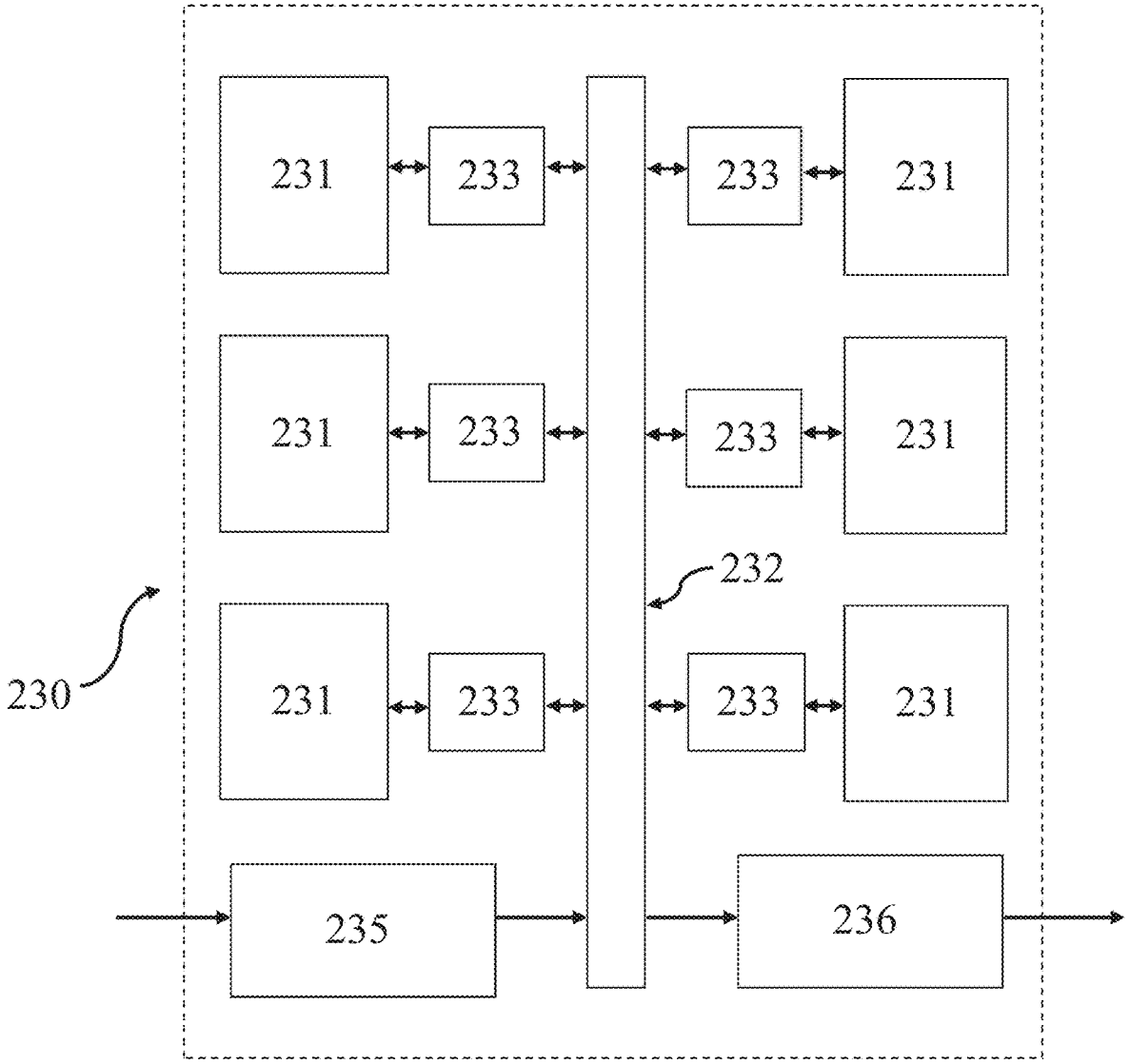
FIG. 2B is a schematic diagram of a power storage system as used in the embodiment of the hydraulic fracturing power system of FIG. 2A.

FIG. 2B is a schematic depiction of the PSS 230 of the embodiment of the hydraulic fracturing power system 200 of FIG. 2A. The PSS 230 can include a plurality of battery banks 231, each connected to a common PSS bus 232 via a battery bank circuit breaker 233. The common PSS bus 232 is also connected to an incoming PSS circuit breaker 235 and an outgoing PSS circuit breaker 236. Outgoing PSS circuit breaker 236 is in turn electrically connected to circuit breaker 215 in the switchgear housing 250.

Many of the connections in the PSS 230—between the battery banks 231 and battery bank circuit breakers 233, and the battery bank circuit breakers 233 and the common PSS bus 232—are two way connections, as indicated by double headed arrows. This means that electricity flows in both directions between the various components. One advantage to this configuration is the ability of the battery banks 131 within the PSS 130 to constantly discharge and recharge as needed. During a typical operation, power will discharge from the battery banks 231 to the circuit breaker 215 via the battery bank circuit breakers 233, the common PSS bus 232, and the outgoing PSS circuit breaker 236. Simultaneously, or as needed, power from the power source will recharge the battery banks 231 via the incoming PSS circuit breaker 235, the common bus 232, and the battery bank circuit breakers 233.

Figure 3A:
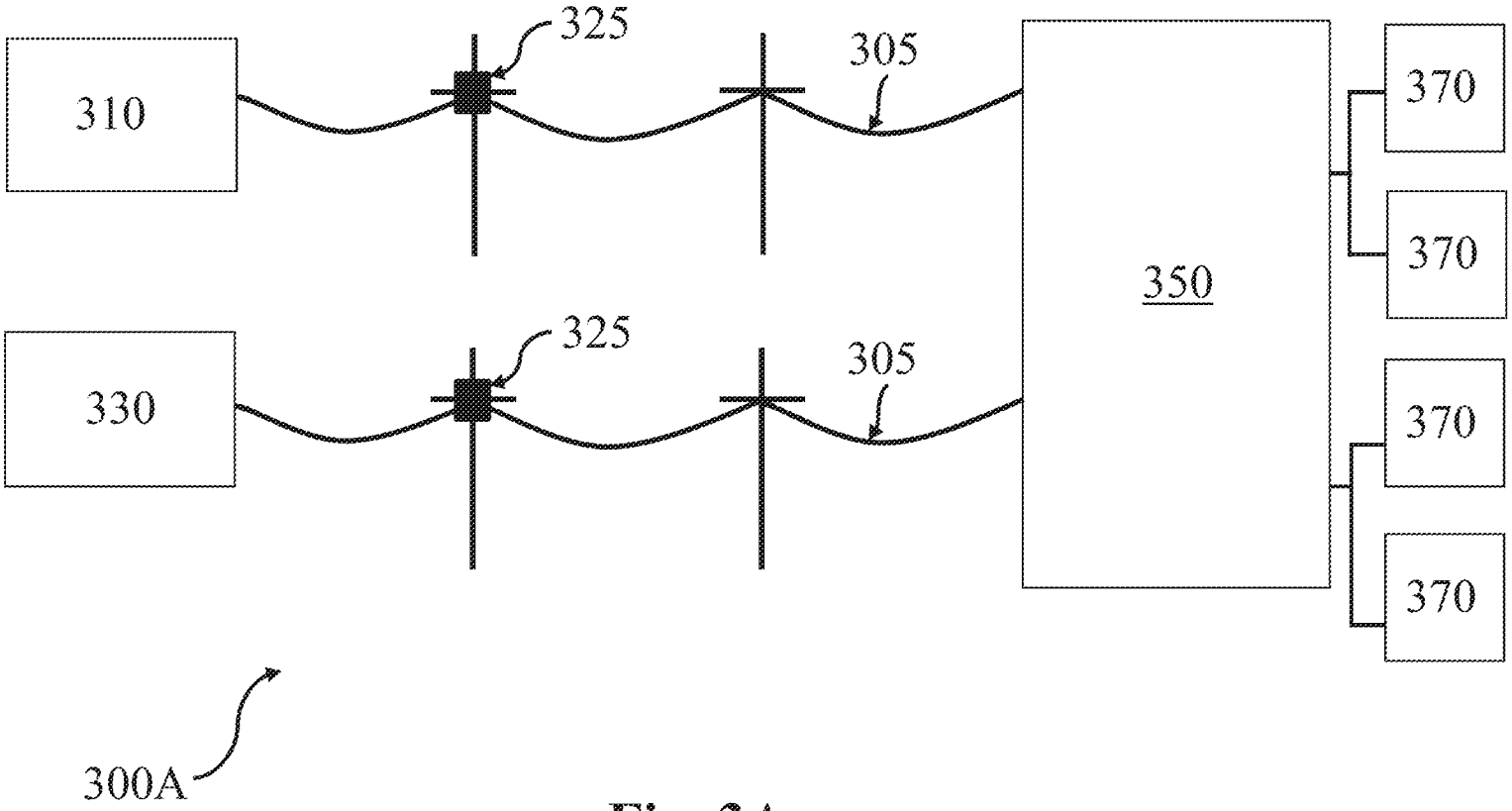
FIG. 3A is a schematic diagram of a hydraulic fracturing power system according to another alternate embodiment of the present technology.

As shown in FIG. 3A, in certain embodiments of the technology, the hydraulic fracturing power system 300A can alternatively be powered by power transmission lines 305, with the power source 310 and the PSS 330 providing parallel power to the switchgear 350. In such an embodiment, the power source 310 and the PSS 330 can each be attached to circuit breakers within the switchgear housing, which are in turn connected to the hydraulic fracturing equipment 370. This arrangement is similar to the embodiment shown in FIG. 1A, except that the power source 310 and the PSS 330 can be located at a remote location. The configuration of the circuit breakers within the switchgear housing 350 can be substantially similar to that of circuit breakers 120, 140, 180, 190 in the embodiment shown in FIG. 1A. In addition, the PSS 330 can have a similar structure to that described above and shown in FIG. 1B.

The arrangement shown in FIG. 3A, including the use of power transmission lines 305, could be beneficial if, for example, space at a well site is restricted, and power generation has to be stationed some distance from the pad. In such an embodiment, cables can be sized properly due to distance, and additional protection can be installed for safety reasons, such as three phase reclosers 325 (small circuit breakers placed at distribution poles to clear faults on cables that are running long distances). In the embodiment of FIG. 3, the PSS 330 can be connected to the transmission lines for remote operations, but may still draw power from the power source 310.

Figure 3B:
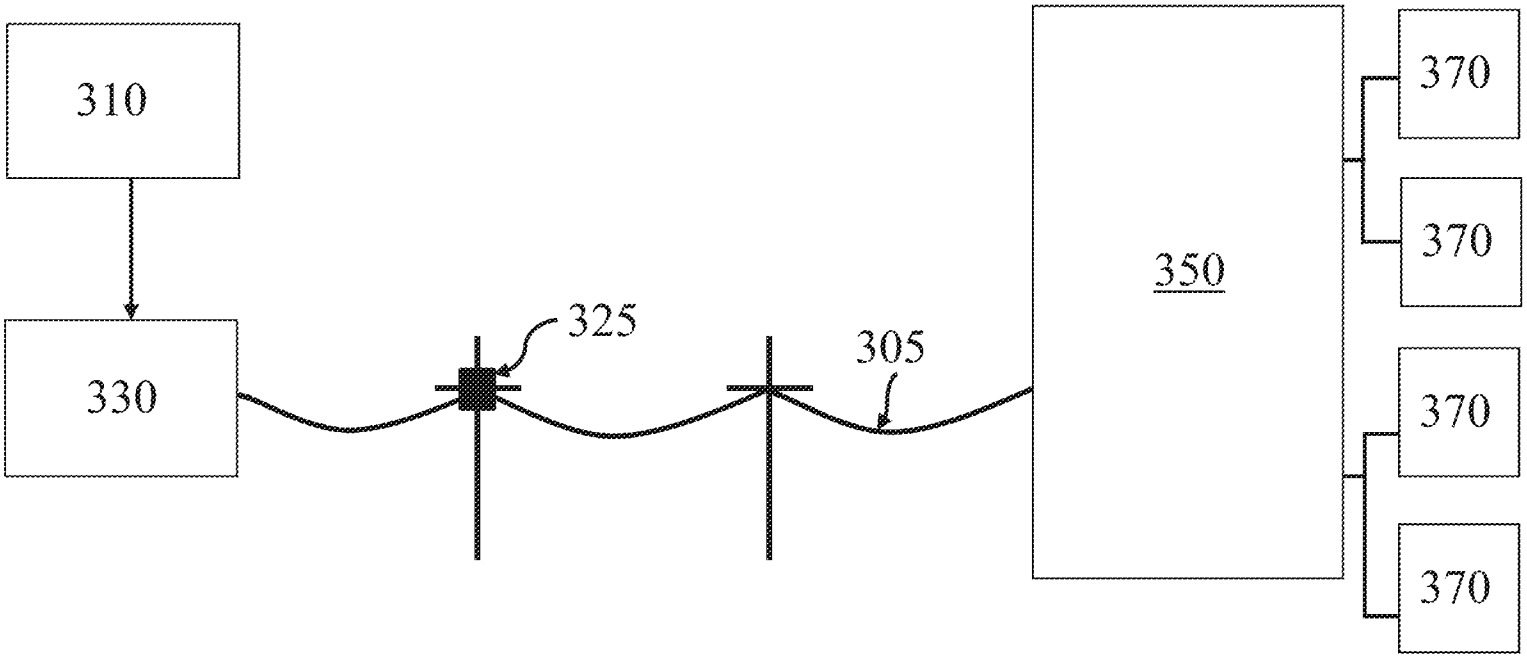
FIG. 3B is a schematic diagram of an alternate embodiment of the hydraulic fracturing power system of FIG. 3A.

FIG. 3B shows an embodiment of the hydraulic fracturing power system 300B that shares characteristics of the embodiments of FIGS. 2A and 3A. That is, both the power source 310 and the PSS 330 are located at a remote location from the switchgear 350, and they are connected to the switchgear 350 in series. One advantage to this embodiment is that it requires only one set of transmission lines 305 between the power source 310/PSS 330 and the switchgear 350. In this embodiment, the configuration of the circuit breakers within the switchgear housing 350 can be substantially similar to that of circuit breakers 215, 280, 290 in the embodiment shown in FIG. 2A. In addition, the PSS 330 can have a similar structure to that described above and shown in FIG. 2B.

Figure 4A:
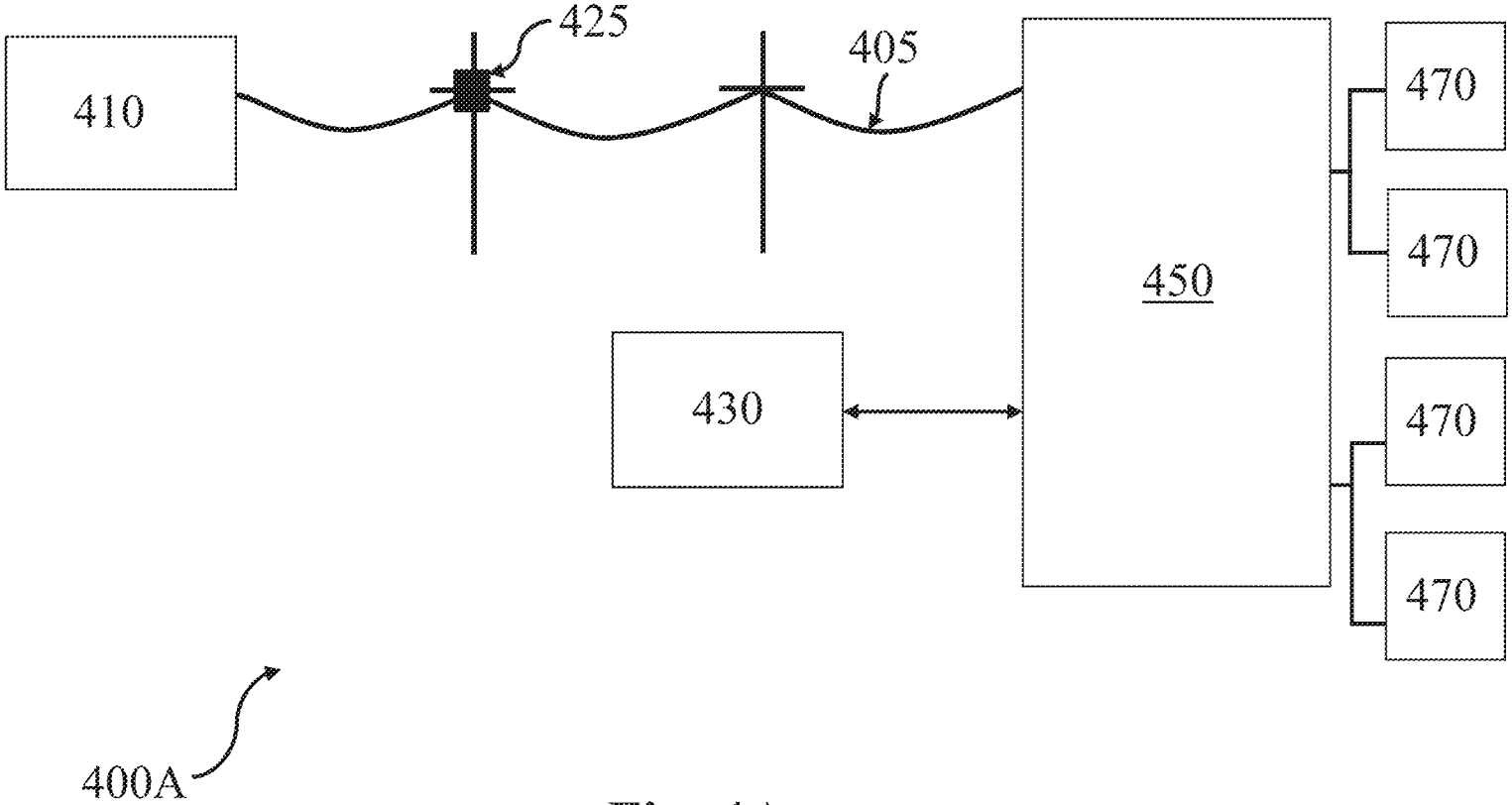
FIG. 4A is a schematic diagram of a hydraulic fracturing power system according to yet another alternate embodiment of the present technology.

In yet another embodiment, shown in FIG. 4A, the hydraulic fracturing power system 400A can include similar features to the embodiment shown in FIG. 3A, including a power source 410 and a PSS 430. Moreover, the power source 410 is connected to the switchgear 450 via power transmission lines 405, and the power transmission lines can include safety features, such as reclosers 425. In the embodiment of FIG. 4A, the PSS 430 can also provide ancillary power. For example, if the power source 410 is a generator, and the generator shuts down during a fracturing stage, the PSS 430 can provide power to hydraulic fracturing equipment 470, including pumps, in order to flush the well so that chemicals and sand previously being pumped through the well can be completely removed from the well.

Figure 4B:
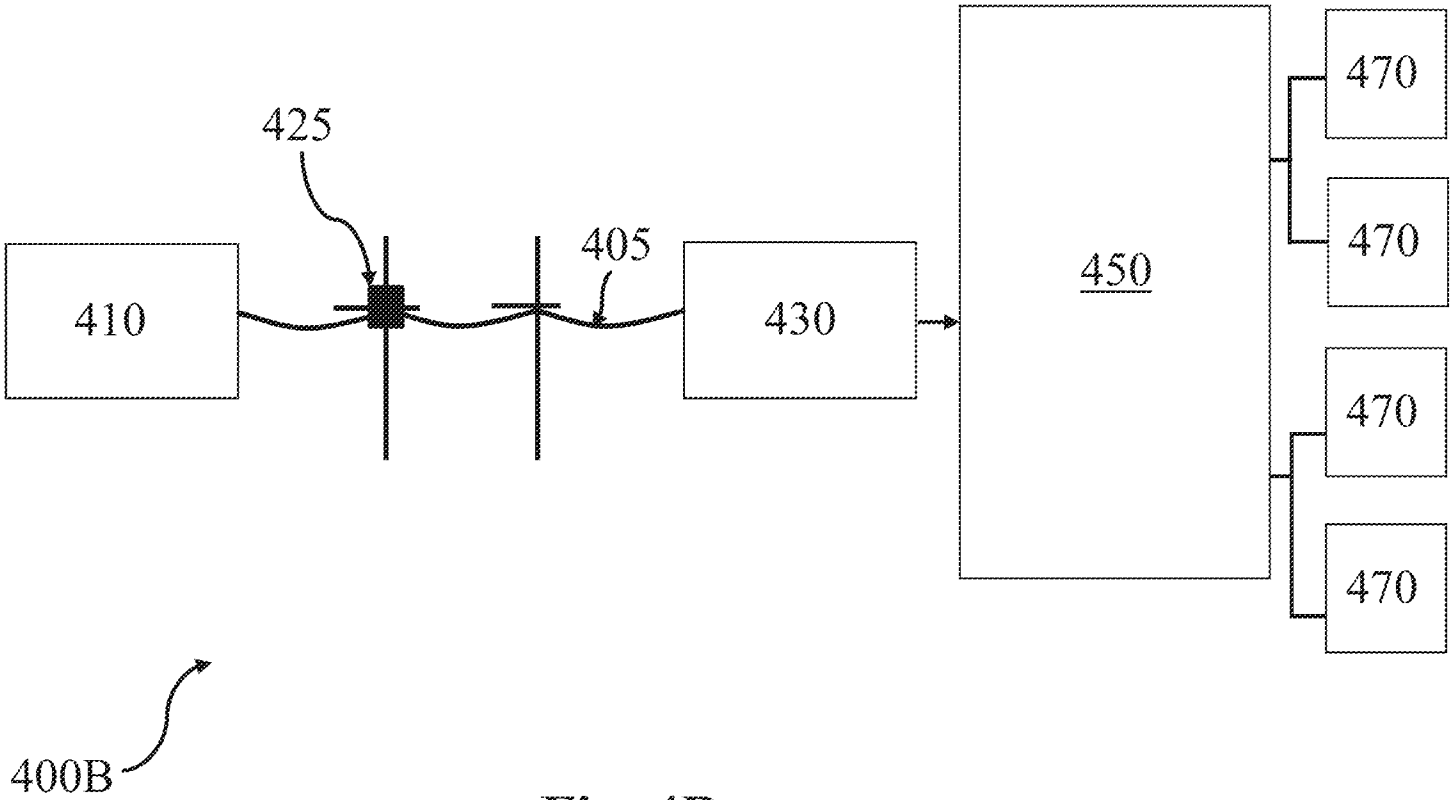
FIG. 4B is a schematic diagram of an alternate embodiment of the hydraulic fracturing power system of FIG. 4A.

FIG. 4B shows an embodiment of the hydraulic fracturing power system 400B that shares characteristics of the embodiments of FIGS. 2A and 4A. That is, the power source 410 is located at a remote location switchgear 350, the PSS 430 is located at the well site, and the power source 410 and PSS 430 are connected to the switchgear 450 in series. One advantage to this embodiment is that the PSS 430 can provide power to the hydraulic fracturing equipment 470 even if the transmission lines 405 fail. Another advantage is that placing the PSS 430 at the wellsite allows for the provision of power at the wellsite without any local emissions or appreciative noise. In this embodiment, the configuration of the circuit breakers within the switchgear housing 450 can be substantially similar to that of circuit breakers 215, 280, 290 in the embodiment shown in FIG. 2A. In addition, the PSS 430 can have a similar structure to that described above and shown in FIG. 2B.

Another alternative embodiment of the present technology provides a hydraulic fracturing power system where the PSS can be used as black start for a power source that is a generator. Black starting is the process of supplying power to a generator that has been completely shut down to get it back up and running. Black start power can be used to power many different systems internal to a primary generator, including, for example, lighting, controls, blowers, cooling systems, lube pumps, oil pumps, starting motors, etc, until the generator is up and running and can provide its own power for these ancillary systems. Diesel generators can usually do this with battery power, but turbine generators require a larger power source, especially if gas compressors need to be operating before the engine can be fired. The configuration of the PSS relative to the switchgear and equipment in such a case can be similar to the embodiments shown in FIGS. 1-4. If enough power is stored in the batteries, the PSS system could support black starting operations without the need for a smaller standby generator to act as the black start power source. However, it could also utilize an external power source, such as solar panels, to recharge the storage system.

Use of the PSS in hydraulic fracturing power system of the present technology provides numerous advantages over known systems, including load leveling, frequency regulation, power quality control, emergency power, black start power, load bank capabilities, equipment reduction, reduced maintenance, and a simplified fuel supply. Each of these features is discussed in detail herein below.

First, with regard to load leveling, the PSS of the present technology has the ability to store electricity in times of low demand, and then to release that electricity in times of high power demand. As applied to electric powered hydraulic fracturing, stages that require relatively less load can provide a time for the PSS to charge up, or store electricity. In addition, the PSS can charge between stages or at the beginning of stages before full pump rate is achieved. Thereafter, power can be released in the stages of higher load requirements. This helps in increasing the lifespan of a power generating asset by decreasing its workload.

With regard to frequency regulation, the PSS can charge and discharge in response to an increase or decrease of microgrid frequency to maintain stored electricity within prescribed limits. This increases grid stability. In other words, the PSS can ramp up or down a generating asset in order to synchronize the generator with microgrid operation.

With regard to power quality control, the PSS can protect downstream loads such as sensitive electronic equipment and microprocessor based controls against short-duration disturbances in the microgrid that might affect their operation.

With regard to emergency power, in the event of a generator failure (due to, for example, a mechanical fault, electric fault, or due to a fuel supply loss), the PSS can provide sufficient electric power to flush the wellbore. This feature can prevent a "screen out" where the loss of fluid velocity causes the proppant in the hydraulic fracturing fluid or slurry to drop out and settle in the wellbore. Such a screen out can plug off the perforations and cause several days of downtime to clear. A screen out is a major concern in hydraulic fracturing and is considered a failure. The PSS can allow an electric hydraulic fracturing fleet to properly flush the well by being able to power the electric blender as well as sufficient hydraulic fracturing pumps to displace the proppant-laden slurry completely into the formation without generator power.

With regard to black start power, normally a small generator can be used to provide power to ancillary systems such as heaters, blowers, sensors, lighting, programmable logic controllers, electric over hydraulic systems, and electric over air systems for the larger generators. Such a generator can also be used to power the starters for these larger generators, which are often electric starters with a variable frequency drive or soft starter, or can be hydraulic starters with electric motors powering the hydraulic pumps. If the PSS is properly charged, it can replace the black start generator to allow the larger generators (often turbines) to start from a black out condition.

With regard to load bank capabilities, the PSS can be used to test and verify generator performance during commissioning or after mobilization. It can also work for load rejections, to dissipate power during sudden shut downs, such as if the wellhead exceeds the maximum pressure and every frac pump needs to shut down simultaneously without warning.

With regard to equipment reduction, using an electricity storage system can allow electric fracturing operations to eliminate or reduce the use of a black start generator or supplemental generator, or a standby generator. Many times more than one large turbine generator is desired to provide power during peak demand during a hydraulic fracturing stage. Other times, a secondary generator can be held electrically isolated in standby in the event of a primary generator failure. Such secondary turbines can be replaced by the PSS, resulting in lower noise levels, less equipment on a pad, and faster mobilization times between well sites.

With regard to the reduced maintenance requirements, in some embodiments the PSS can be comprised of a solid state battery bank having very few moving parts. Thus, the PSS will require less maintenance than a generator utilizing a turbine or reciprocating engine.

With regard to the simplified fuel supply, in embodiments where the PSS is replacing a secondary or standby generator, the PSS will not require any fuel supply as it can be energized by a power grid. Therefore, any fuel connections for liquid or gas fuel can be removed from the system. This allows for a reduction in the number of connections and manifolds, as well as a reduction in the fuel volumes required during peak demand. In embodiments where the PSS replaces, for example, one of two turbines, all of the fuel equipment, hoses, and manifolding can be greatly reduced and simplified.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

That claimed is:

1. A hydraulic fracturing power system, comprising:

a power source;

a power storage system;

an electric powered hydraulic fracturing pump configured to pressurize fluid in a wellbore to conduct hydraulic fracturing operations, and in selective electrical communication with the power source, the power storage system, or both; and at least one circuit breaker between the power source, the power storage system, or both, and the electric powered hydraulic fracturing pump, the circuit breaker having an open position that opens an electric circuit between the electric powered hydraulic fracturing pump and the power source, the power storage system, or both, and a closed position that closes the electric circuit, the at least one circuit breaker varying between the open position and the closed position as required to power the electric powered hydraulic fracturing pump and maintain a charge in the power storage system.

2. The hydraulic fracturing power system of claim 1, wherein the power storage system is at least one solid state battery selected from the group consisting of electrochemical capacitors, lithium ion batteries, nickel-cadmium batteries, and sodium sulfur batteries.

3. The hydraulic fracturing power system of claim 2, wherein the power storage system is at least one flow battery selected from the group consisting of redox batteries, iron-chromium batteries, vanadium redox batteries, and zinc-bromine batteries.

4. The hydraulic fracturing power system of claim 3, wherein the at least one battery is rechargeable.

5. The hydraulic fracturing power system of claim 1, wherein the at least one circuit breaker comprises a first circuit breaker and a second circuit breaker, the first circuit breaker electrically connected to the power source, and the second circuit breaker electrically connected to the power storage system.

6. The hydraulic fracturing power system of claim 5, wherein each of the first circuit breaker and the second circuit breaker is electrically connected to the electric powered hydraulic fracturing pump via a common bus.

7. The hydraulic fracturing power system of claim 1, wherein the at least one circuit breaker is a first circuit breaker, and wherein both the power source and the power storage system are electrically connected to the first circuit breaker.

8. The hydraulic fracturing power system of claim 1, wherein at least one of the power source and the power storage system are electrically connected to the at least one circuit breaker via a power line.

9. The hydraulic fracturing power system of claim 1, wherein the power storage system is mounted to a trailer.

10. The hydraulic fracturing power system of claim 1, wherein the at least one circuit breaker is substantially enclosed in a switchgear housing.

11. A system for powering an electric hydraulic fracturing pump, comprising:

a power storage system having;

an electric powered hydraulic fracturing pump configured to pressurize fluid in a wellbore to conduct hydraulic fracturing operations, and in selective electrical communication with the power storage system; and at least one circuit breaker between the power storage system and the electric powered hydraulic fracturing pump, the circuit breaker configured to facilitate or prevent electrical communication between the power storage system and the electric powered hydraulic fracturing pump and;

a power source wherein both the power source and the power storage system are electrically connected to the at least one circuit breaker, and the at least one circuit breaker facilitates or prevents communication between the power storage system, the power source, and the electric powered hydraulic fracturing pump as required to power the electric powered hydraulic fracturing pump and maintain a charge in the power storage system.

12. The system for powering the electric hydraulic fracturing pump of claim 11, wherein the power storage system is at least one solid state battery selected from the group consisting of electrochemical capacitors, lithium ion batteries, nickel-cadmium batteries, and sodium sulfur batteries.

13. The system for powering the electric hydraulic fracturing pump of claim 12, wherein the power storage system is at least one flow battery selected from the group consisting of redox batteries, iron-chromium batteries, vanadium redox batteries, and zinc-bromine batteries.

14. The system for powering the electric hydraulic fracturing pump of claim 11 wherein the at least one circuit breaker comprises a first circuit breaker and a second circuit breaker, the first circuit breaker electrically connected to the power source, and the second circuit breaker electrically connected to the power storage system.

15. The system for powering the electric hydraulic fracturing pump of claim 11 wherein at least one of the power source and the power storage system are electrically connected to the at least one circuit breaker via a power line.

16. The system for powering the electric hydraulic fracturing pump of claim 11, wherein the at least one circuit breaker is substantially enclosed in a switchgear housing.

17. The system for powering the electric hydraulic fracturing pump of claim 11, wherein the power storage system is rechargeable.

18. The system for powering the electric hydraulic fracturing pump of claim 16 wherein the power source is electrically connected to the at least one circuit breaker via a power line, and where the power storage system is located adjacent the switchgear housing and electrically coupled directly to the switchgear housing without a power line.

19. The system for powering the electric hydraulic fracturing pump of claim 16, further comprising:

software in communication with the power storage system, the software configured to monitor the state of the power storage system and to integrate control of the power storage system with other features of the system for powering electric hydraulic fracturing equipment.

* * * * *